US011072015B2

(12) United States Patent
Roth et al.

(10) Patent No.: US 11,072,015 B2
(45) Date of Patent: Jul. 27, 2021

(54) INCREMENTAL FORMING TOOLS AND METHOD

(71) Applicant: The Penn State Research Foundation, University Park, PA (US)

(72) Inventors: John Timothy Roth, Mckean, PA (US); Tyler John Grimm, Beaver, PA (US); Glenn Craig, Erie, PA (US)

(73) Assignee: THE PENN STATE RESEARCH FOUNDATION, University Park (PA)

( * ) Notice: Subject to any disclaimer, the term of this patent is extended or adjusted under 35 U.S.C. 154(b) by 200 days.

(21) Appl. No.: 16/085,185

(22) PCT Filed: Mar. 22, 2017

(86) PCT No.: PCT/US2017/023620
§ 371 (c)(1),
(2) Date: Sep. 14, 2018

(87) PCT Pub. No.: WO2017/165541
PCT Pub. Date: Sep. 28, 2017

(65) Prior Publication Data

US 2019/0099799 A1 Apr. 4, 2019

Related U.S. Application Data

(60) Provisional application No. 62/311,689, filed on Mar. 22, 2016.

(51) Int. Cl.
*B21D 31/00* (2006.01)

(52) U.S. Cl.
CPC ..... *B21D 31/005* (2013.01)

(58) Field of Classification Search
CPC ..... B21D 31/00; B21D 31/005; B21D 22/14; B21D 22/18
See application file for complete search history.

(56) References Cited

U.S. PATENT DOCUMENTS 3,760,676 A 9/1973 Daniels
6,441,338 B1 * 8/2002 Rabinovich ..... B26F 1/44 219/121.64

(Continued)

FOREIGN PATENT DOCUMENTS

CN 203109036 U 8/2013
CN 104690138 A 6/2015

(Continued)

OTHER PUBLICATIONS

Belt and Boxes, YouTube: 2015 Cordless Hammer Drill Challenge—Bosch, Dewalt, Makita, Metabo, Milwaukee, 2:28, https://www.youtube.com/watch?time_continue=333&v=VjJ2XwqdCJ0&feature=emb_logo (Year: 2015).*

(Continued)

*Primary Examiner* — Adam J Eiseman
*Assistant Examiner* — Bobby Yeonjin Kim
(74) *Attorney, Agent, or Firm* — Dinsmore & Shohl LLP

(57) ABSTRACT

An incremental forming tool of a sheet material has a tool holder having an axis and at least one tool rod mounted in the tool holder. The at least one tool rod may have variable shapes, lengths, diameters and radii such that the rotation of the at least one tool rod about the axis of the tool holder on the sheet material simulates an up and down, in and out, and/or side-to-side vibration motion.

18 Claims, 19 Drawing Sheets

(56) References Cited

U.S. PATENT DOCUMENTS

| | | | | |
|---|---|---|---|---|
| 9,511,415 | B2 * | 12/2016 | Nonomura | B21J 5/00 |
| 2005/0081591 | A1 * | 4/2005 | Desousa | B21D 41/04<br>72/121 |
| 2010/0044063 | A1 | 2/2010 | Chen | |
| 2011/0308294 | A1 * | 12/2011 | Erlenmaier | B44B 5/0004<br>72/430 |
| 2014/0150510 | A1 * | 6/2014 | Beltran | B21D 37/16<br>72/19.1 |
| 2014/0345351 | A1 * | 11/2014 | Roth | B21J 1/06<br>72/54 |
| 2015/0000108 | A1 * | 1/2015 | Hascoet | B23K 26/083<br>29/527.2 |
| 2016/0136714 | A1 * | 5/2016 | Kiridena | B21D 31/005<br>72/115 |
| 2018/0185921 | A1 * | 7/2018 | Tong | B21D 31/005 |

FOREIGN PATENT DOCUMENTS

| | | | | |
|---|---|---|---|---|
| CN | 104858281 | A | 8/2015 | |
| DE | 102014014202 | A1 * | 3/2016 | B23P 23/04 |
| KR | 101282750 | B1 | 7/2013 | |

OTHER PUBLICATIONS

Tekkaya, translation of DE-102014014202-A1 (Year: 2016).*

* cited by examiner

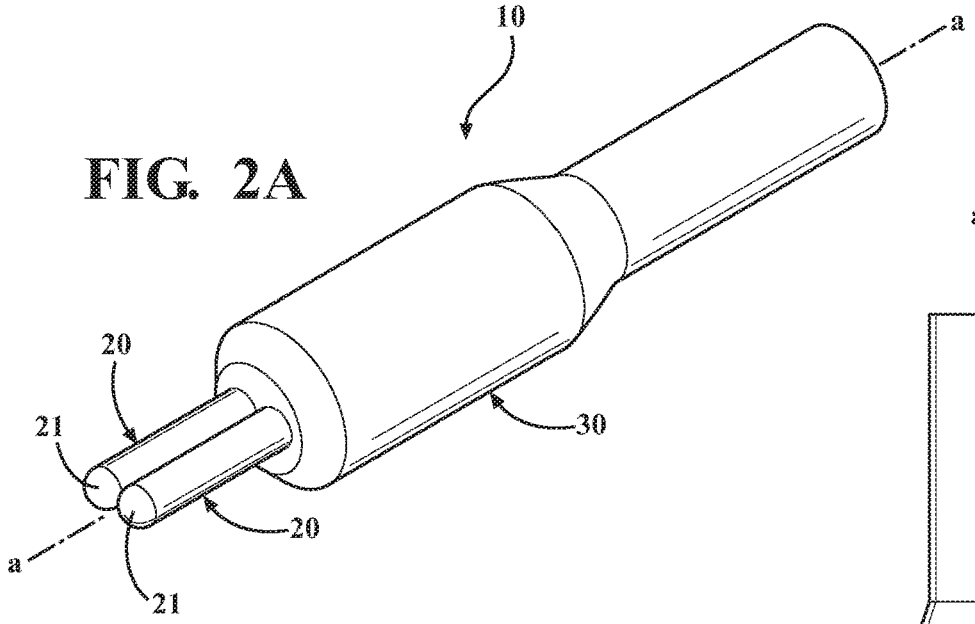
FIG. 2A
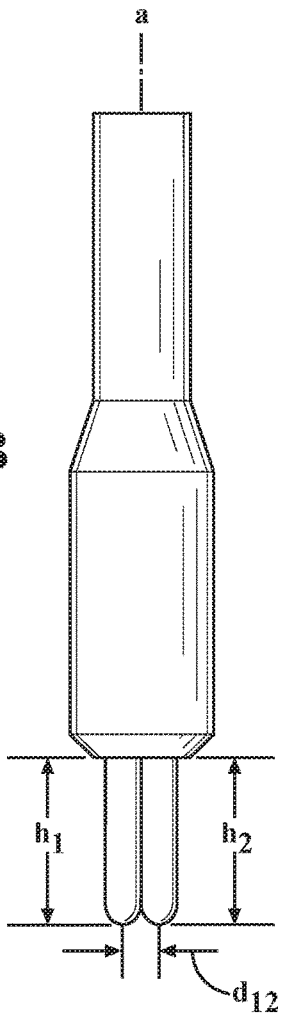
FIG. 2B
FIG. 2C
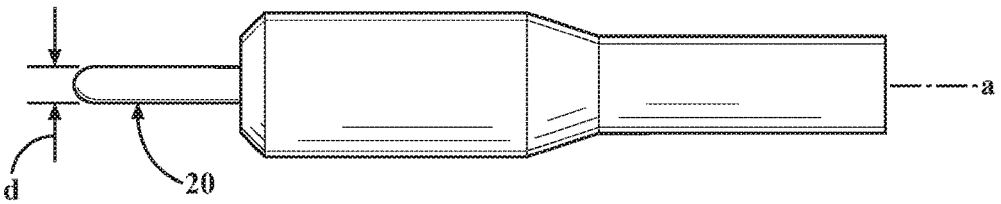
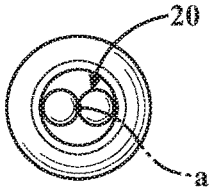
FIG. 2D

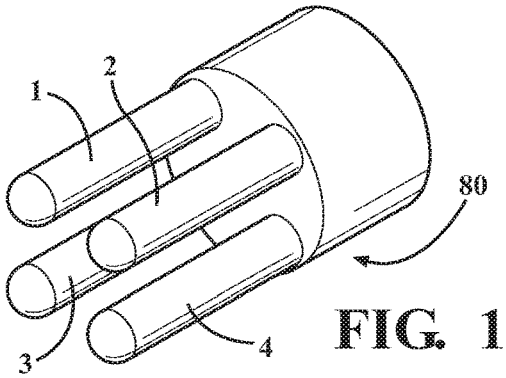
FIG. 18A
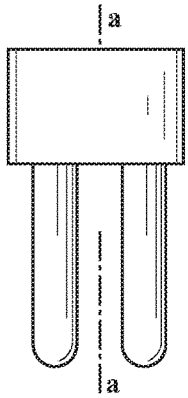
FIG. 18B
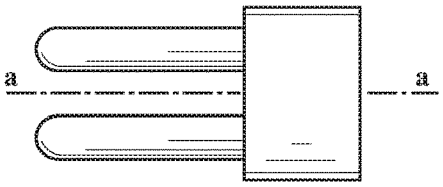
FIG. 18C
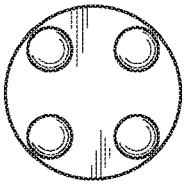
FIG. 18D
FIG. 19A
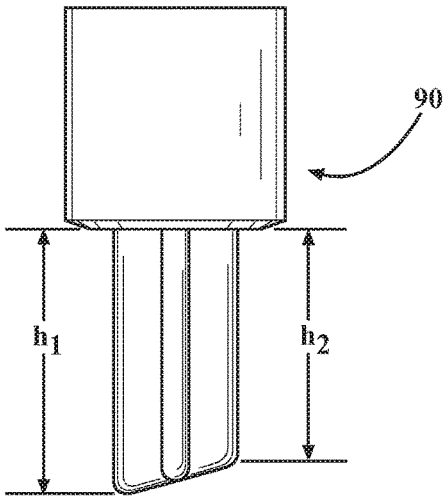
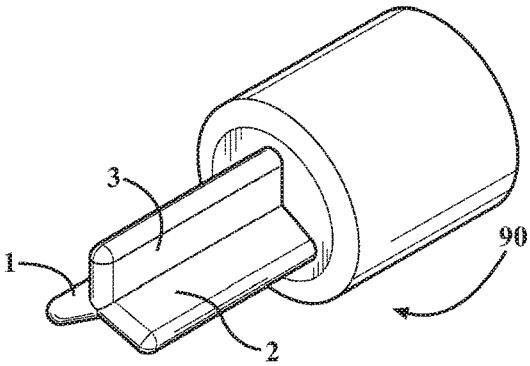
FIG. 19B
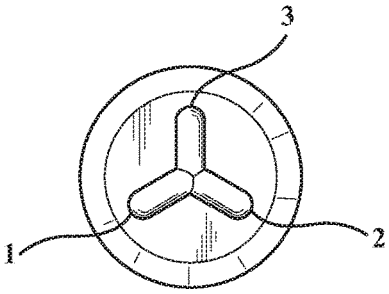
FIG. 19C
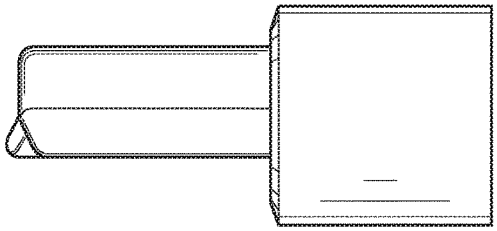
FIG. 19D

FIG. 32
| RPM | Percentage Springback Elimination |
|---|---|
| 300 | 13 |
| 600 | 12 |
| 900 | 10 |
| 1,200 | 8 |
| 2,100 | -6 |
| 3,000 | 1 |
| 3,900 | 2 |
| 4,800 | 15 |
| 5,700 | 16 |
| 6,000 | 21 |
FIG. 33
| RPM | Percentage Springback Elimination |
|---|---|
| 0 | 47.1 |
| 600 | 51.1 |
| 1,200 | 54.1 |
| 1,800 | 54.0 |
| 2,400 | 54.3 |
| 3,000 | 55.3 |
| 3,600 | 57.8 |
| 4,200 | 53.5 |
FIG. 34A
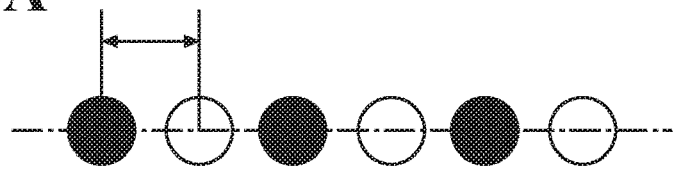
FIG. 34B
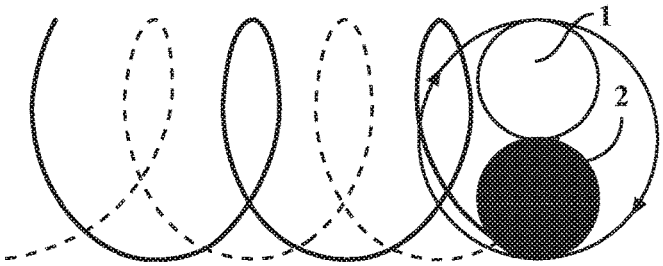

INCREMENTAL FORMING TOOLS AND METHOD

REFERENCE TO RELATED APPLICATION

This application is the U.S. national stage of PCT/US2017/023620 filed Mar. 22, 2017, which claims priority of U.S. Provisional Patent Application 62/311,689 filed Mar. 22, 2016 of which is hereby incorporated by reference in its entirety.

FIELD OF INVENTION

The present invention is related to the deformation of sheet materials and, more particularly, related to a new tool and method used for incremental forming of sheet materials. The tool and method can be applied to single point, double-sided, and multi-axis incremental forming.

BACKGROUND OF THE INVENTION

Incremental sheet forming is a sheet material forming technique where a sheet is formed into a final part by a series of small incremental deformations. Generally, a sheet is formed by a small-sized solid round-tipped forming tool having continuous contact with the sheet material and machinery that moves the forming tool in a controlled manner in a three-dimensional space.

With incremental forming, the total achievable deformation and the surface finish are both controlled by the tool geometry. Each time that the tool completes a circuit around the part being formed, it is stepped downward, either as a single circuit with a following step or through the use of a spiral or helical tool path. One effect of this is that ridges may be left in the part due to this incremental step. In the conventional tooling, the plowing effect exists, which is the pushing of material in-front of the traditional sliding tool contact. These effects affect the surface finish of the final part.

SUMMARY OF THE INVENTION

A method is provided simulating vibrating the forming tool at a high frequency in all three-dimensional directions, essentially moving up and down, side to side, in and out, or any combination thereof between two steps in order to smooth the surface, improve formability, and control the part's geometrical compliance.

An incremental forming tool for incremental forming of a sheet material is provided, including a tool holder having an axis and one or more tool rod mounted in the tool holder. Each tool rod has a height, a cross-sectional shape, a dimension, an offset and a head. The tool rod is shaped such that a rotation of the at least one tool rod about the axis of the tool holder on the sheet material simulates an up and down, in and out, and/or side-to-side vibration motion.

During the forming, the tool rods repeatedly touch and release the sheet material. The "deform and release" repetition is used to modify the material flow during deformation and also to remove the "plowing" effect that is frequently found in existing tooling. The plowing effect is the pushing of material in front of the traditional sliding tool contact. The pulsing of the deformation is the cause, to a large extent, for the improved formability and decreased springback (part compliance). The vibration also allows greater lubricant to reach the tool/sheet material interface.

In one embodiment, an incremental forming tool with two rods is provided to create a motion similar to vibration of the tool in three-dimensional directions. Each tool rod has a circular cross section and a head of each tool rod is hemispherical. The heights, radii, and/or offsets may vary. One way of achieving this motion is by rotating the tool head about an axis of the tool holder during the forming process.

The incremental forming tool may be a split tool made by mating two halves of a hemisphere together. One half may be slightly longer than the other. In one embodiment, the distance between two halves is employed to create a stepped distance roughly equal to the incremental step size. The tool would be set so that the tool path is aligned with the middle of this stepped distance such that the tool would go up half a step and down half a step from that position as the tool rotates. The stepped distance is adjustable and may be equal to a distance other than the incremental step size.

Alternatively, there may be more than two tool rods mounted in the tool holder. The tool rods each have a height, shape, and offset from the central axis of the tool holder. The radii of the tool rods may each be different. The tool rods may each have a different shape. The tool rods may each be disposed at a different distance (offset) from the axis of the tool holder.

In some embodiments, the tool rod has a polygonal cross section defining a plurality of forming ends each with an edge, the edges of each forming end having a different radius. In some versions, a central region at the head of the tool rod is in-plane with the forming ends. In other versions, the central region at the head of the tool rod is raised up or lowered down relative to the forming ends.

In some embodiments, the tool rod has a clover-shaped cross section having a plurality of petals, each petal having a dimension and a radius. The dimensions and/or radii of each of the petals may be same or may be different from one another.

In some embodiments, the tool rod has an oval-shaped cross section and one end of the oval shape has a larger radius than the other end.

In some embodiments, the tool rod has a spiral shape. In some embodiments, the tool rod includes one or more protrusions at the surface of the head.

In some embodiments, the head of the tool rod is shaped as a vertical sine wave. The number of peaks and troughs of the sine wave may vary. In some versions, a central region of the head is in plane with peaks of the vertical sine wave. In other versions, the central region of the head is raised relative to peaks of the vertical sine wave.

The head of the tool rods may be shaped with any types of wavy form with peaks and troughs.

In some versions, the tool rods each rotate about a planet axis, while the planet axis rotates about the axis of the tool holder. This configuration may be incorporated into different embodiments. In one example, a tool has multiple tool rods. In another example, a tool has one or more tool rods, each tool rod having multiple forming ends, each tool rod offset from the axis of the tool holder. For example, the tool rod may be a clover-shaped, be polygonal shaped tool rod, or a tool rod may a sine wave shaped forming ends.

Alternatively, a split tool may be made by mating two halves with two different radii. So, the heads of the two tool rods would cause two different contact profiles as the tool rotates, again, approximating a motion that is similar to vibration in one or more directions. A split tool may be made by mating more than two divisions of a circle, each division having different radii or heights.

Alternatively, an incremental forming tool may have tool rods with any contoured shapes that would cause the tool to essentially pulse up and down, in and out, and side-to-side motion during the rotation of the tool rods about an axis.

BRIEF DESCRIPTION OF THE FIGURES

FIG. 2A is a perspective view of an incremental forming tool in accordance with an embodiment of the present invention;

FIG. 2B is a side view of the incremental forming tool in accordance with an embodiment of the present invention as shown in FIG. 2A;

FIG. 2C is another side view of the incremental forming tool in accordance with an embodiment of the present invention as shown in FIG. 2A;

FIG. 2D is an end view of the incremental forming tool in accordance with an embodiment of the present invention as shown in FIG. 2A;

FIG. 18A is a perspective view of an incremental forming tool with four tool rods having typical heights and shapes in accordance with an embodiment of the present invention;

FIG. 18B is a side view of an incremental forming tool with four tool rods having typical heights and shapes in accordance with an embodiment of the present invention shown in FIG. 18A;

FIG. 18C is another side view of an incremental forming tool with four tool rods having typical heights and shapes in accordance with an embodiment of the present invention shown in FIG. 18A;

FIG. 18D is an end view of an incremental forming tool with four tool rods having typical heights and shapes in accordance with an embodiment of the present invention shown in FIG. 18A;

FIG. 19A is a side view of an incremental forming tool with a 3-petal clover-leaf shaped tool rod in accordance with an embodiment of the present invention;

FIG. 19B is a perspective view of an incremental forming tool with a 3-petal clover-leaf shaped tool rod in accordance with an embodiment of the present invention shown in FIG. 19A;

FIG. 19C is an end view of an incremental forming tool with a 3-petal clover-leaf shaped tool rod in accordance with an embodiment of the present invention shown in FIG. 19A;

FIG. 19D is another side view of an incremental forming tool with a 3-petal clover-leaf shaped tool rod in accordance with an embodiment of the present invention shown in FIG. 19A;

FIG. 32 is a table listing showing springback analysis utilizing an incremental forming tool shown in FIGS. 2A-2D;

FIG. 33 is a table listing showing formability analysis utilizing an incremental forming tool shown in FIGS. 2A-2D;

FIG. 34A is a top view showing distance between strikes during horizontal forming;

FIG. 34B is a top view of representation of forming motion showing horizontal forming utilizing an incremental forming tool shown in FIGS. 2A-2D;

DETAILED DESCRIPTION OF THE PREFERRED EMBODIMENTS

Figure 1:
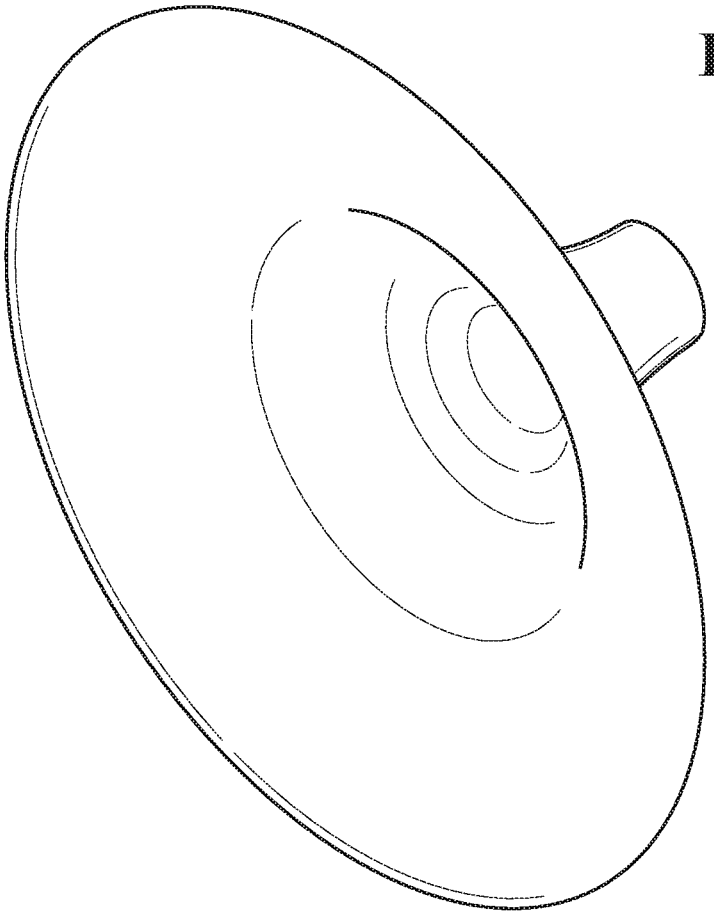
FIG. 1 shows an example CAD model from which a spiral or stepped tool path can be formed; this model is the intended formed geometry of the parts seen in FIGS. 4-13.

The present invention provides various embodiments of tools for incremental forming of sheet metal and methods of using these tools to form sheet metal. Embodiments may have one or more tool rods that are shaped, configured or positioned such that as the tool holder rotates about a tool holder axis, the one or more tool rods simulate an up and down, in and out, and/or side to side motion, which may be referred to as a vibration motion.

FIGS. 2A-2D provide various views of one embodiment of an incremental forming tool 10 in accordance with the present invention. As best shown in FIGS. 2A and 2B, two tool rods 20 are mounted to a tool holder 30 having an axis aa. The tool rods 20 are the forming tools used for incremental sheet material forming. The tool rod has a shape and a height. Each tool rod has a tip or head 21 that comes in contact with the sheet material. The height of a tool rod refers to a total height including the height of the tool rod body and the height of the tip. In one example, the tool rods each are straight and cylindrical with the tips 21 that are uniformly radiused. The tool holder 30 has a generally cylindrical body, which may fit into a tool (not shown) that moves or rotates the forming tool 10. In this embodiment, one of the tool rods 20 is slightly shorter than the other. The stepped distance between the tips of the two rods may be adjustable. In one embodiment, the difference of the stepped distance is roughly equal to the step size during the incremental forming of a part. For example, the height of one tool rod $h_1$ may be 1.7500 inches, while the height of the other tool rod $h_2$ may be 1.7425 inches, giving a difference of 0.0075 inches.

Also shown in FIG. 2D is an end view of the tool tips, showing two circular heads adjacent to each other. The radius of the each rod and its head may be altered depending on the tool and the application. The two rods may be in contact with each other or may have a gap in between. The gap between the two rods may be adjustable. In one example, the radius of each tool rod is 0.1875 inches and the distance between the centers of the two tool rods $d_{12}$ is 0.3750 inches.

One way of using the incremental forming tool of the present invention to simulate vibration, which involves the rotation of the tool in order to create the equivalent of an upward and downward motion. During the incremental forming, the tool rods 20 are rotated about the axis aa such that the tool rods 20 repeatedly contact an area of the workpiece at a contact position. Because the two rods have a slightly different height, the contact area on the workpiece experiences an oscillating motion as one rod and then the other contacts it. Comparing to a conventional incremental forming tool, which creates only a single point contact between the tip of the tool rod and the sheet material, the incremental forming tool embodied in FIGS. 2A-2D creates a double-point contact between the tips 21 of the tool rods 20 and a sheet material. The rotation of the tool causes the individual tool tips to strike the formed wall of the part in a horizontal direction. The forming motion from a top view is shown in FIG. 34B. In FIG. 34B, two forming tool rods 1 and 2 are represented by two smaller circles. The arrow indicates a rotational direction. FIG. 34B also shows how the line typically visible on parts formed using conventional tools is diminished due to the separation of contact regions along the formed wall. Also as a result of the rotation of the tool rods about the axis aa of the tool holder, these two contact points also simulate oscillating up and down due to different heights of the tool rods, thereby reducing or eliminating ridges and creating a smoother surface on the sheet material. FIG. 34A shows the distance between strikes of the two tool tips. The tool rods touch the material and release repeatedly. This deform-then-release repetition is part of what improves the formability, improves compliance and reduces plowing of the material. It is noted that the vibration also allows greater lubricant to reach the tool/workpiece interface.

Alternatively, the heads may be the same and/or the rods have the same length. In this alternative, the upward/downward vibration is not created in the same way but the heads touch and release the surface repeatedly, simulating an oscillating or vibrating motion as a particular contact area is contacted and then not contacted.

Figure 3A:
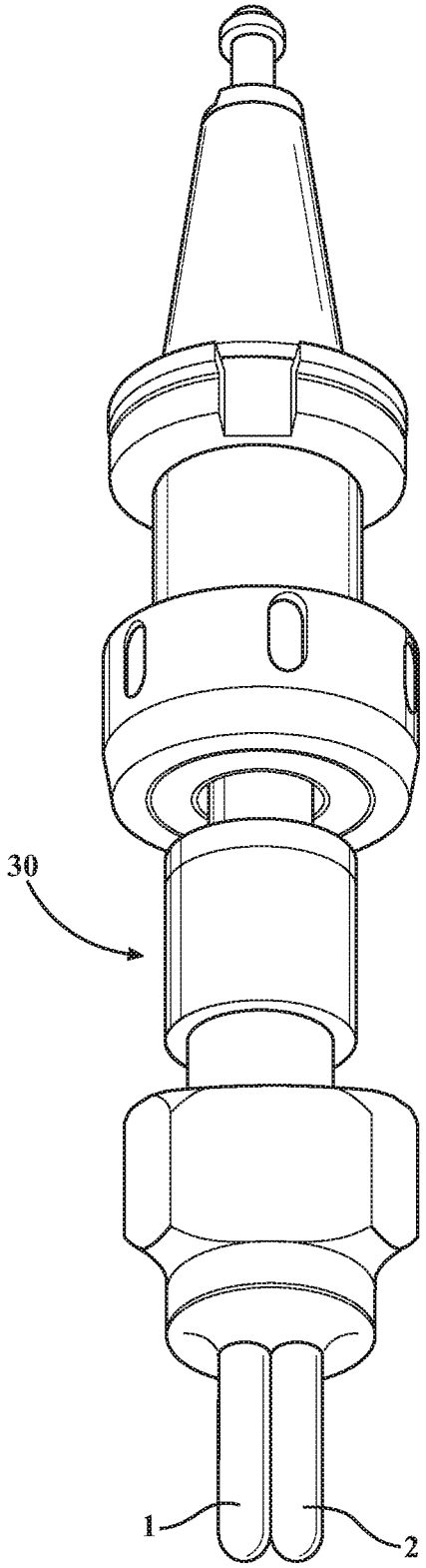
FIG. 3A is a perspective view of an incremental forming tool in accordance with an embodiment of the present invention.
Figure 3B:
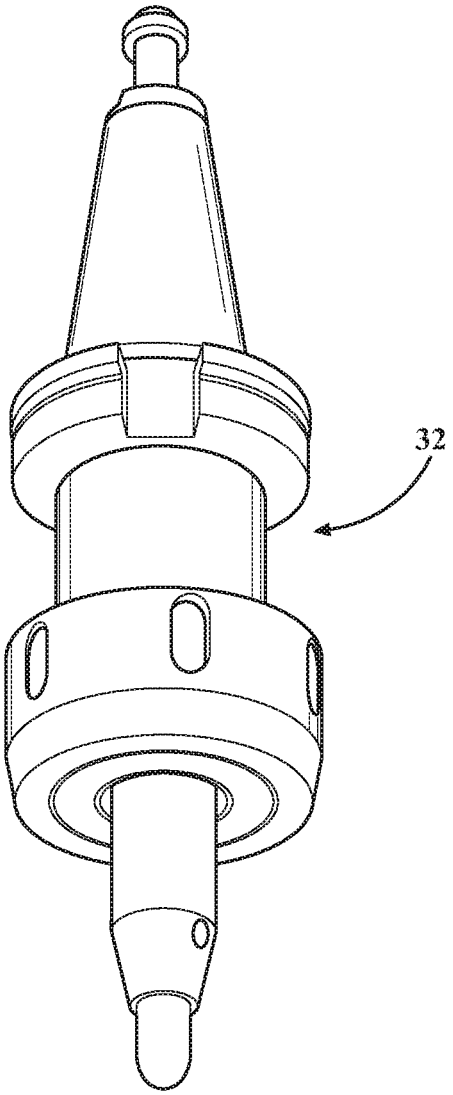
FIG. 3B is perspective view of a conventional incremental forming tool for a side-by-side comparison with the incremental forming tool in accordance with an embodiment of the present invention shown in FIG. 3A.
Figure 4B:
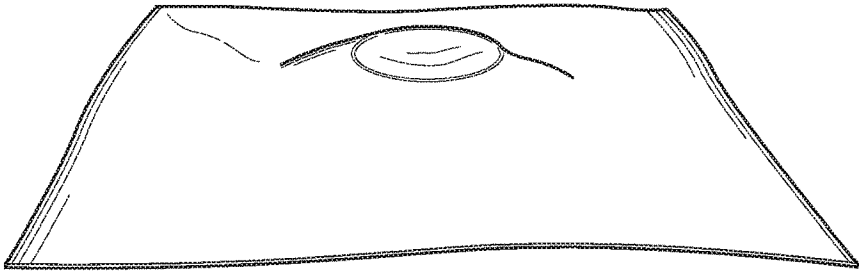
FIG. 4B is a perspective bottom view of a part without fracture formed by a conventional forming tool for a side-by-side comparison with FIG. 4A.
Figure 5B:
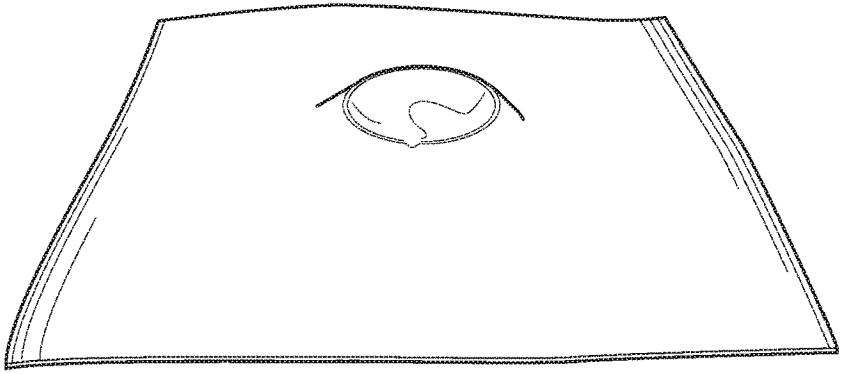
FIG. 5B is a perspective bottom view of a part with fracture formed by a conventional forming tool for a side-by-side comparison with FIG. 5A.
Figure 4A:
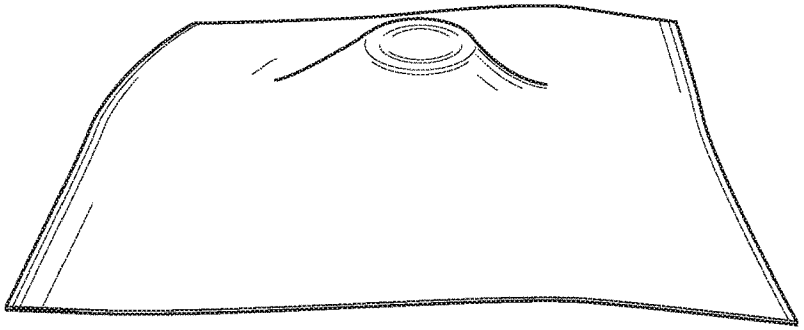
FIG. 4A is a perspective bottom view of a part without fracture formed by an incremental forming tool in accordance with an embodiment of the present invention.
Figure 5A:
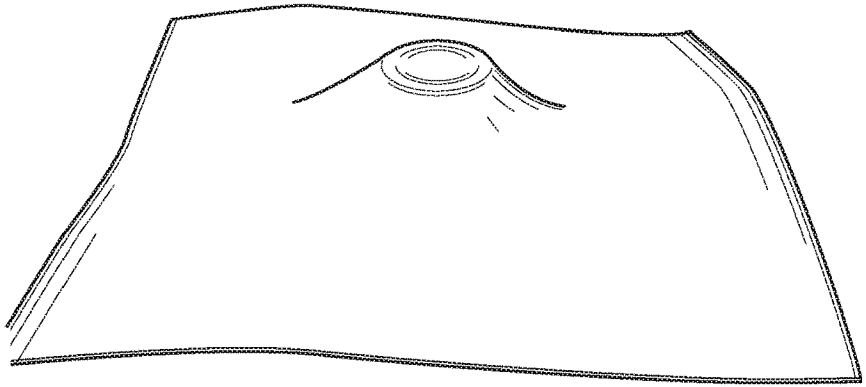
FIG. 5A is a perspective bottom view of a part with fracture formed by an incremental forming tool in accordance with an embodiment of the present invention.

FIGS. 3A and 3B show one type of the incremental forming tool 30 in accordance with the present invention and a conventional forming tool 32, respectively, for comparison. The incremental forming tool includes two tool rods 1 and 2.

The difference that may result from use of this new tool geometry for the incremental forming process is shown in FIGS. 4-13. FIGS. 4A and 4B show a perspective bottom view of a part without fracture formed by an incremental forming tool of the present invention and a conventional forming tool respectively. FIGS. 5A and 5B show a perspective bottom view of a part with fracture formed by an incremental forming tool of the present invention and by a conventional forming tool respectively. A fracture occurs once the material has reached its forming limit. In this particular test, where a funnel shape is formed, the deeper the part can be formed without fracture, the greater the formability of the process. Increasing formability is an improvement to the incremental forming process. Since the wall angle increases in this case as the depth increases, the depth at fracture also indicates the maximum achievable wall angle, which is also increased with the new tooling.

Figure 6A:
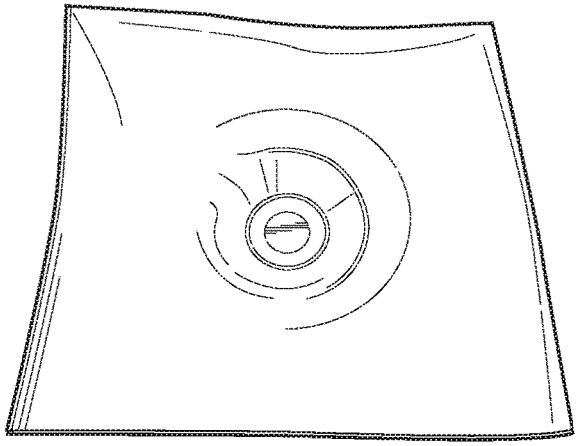
FIG. 6A is a perspective top view of a part formed by an incremental forming tool in accordance with an embodiment of the present invention.
Figure 6B:
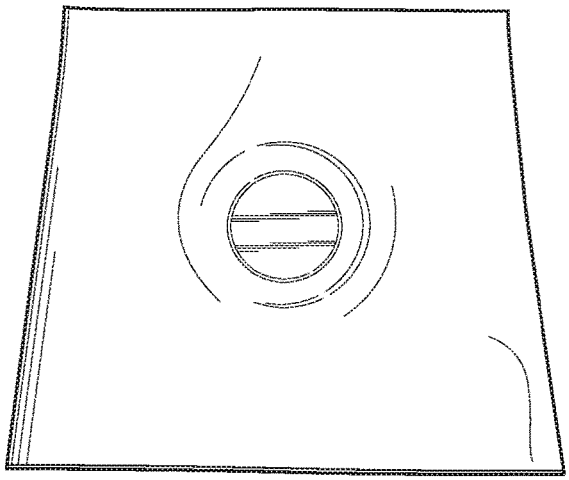
FIG. 6B is a perspective top view of a part formed by a conventional incremental forming tool.
Figure 7A:
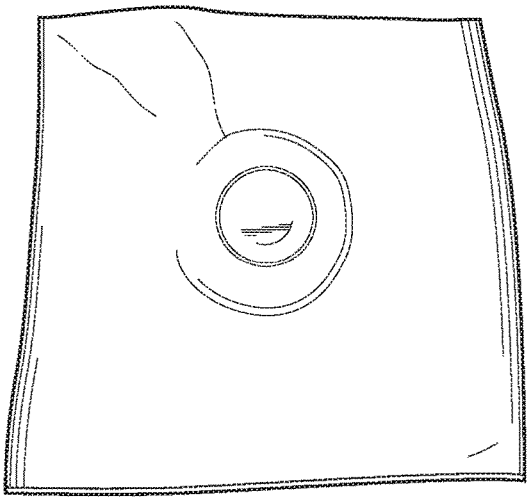
FIG. 7A is a bottom view of a part formed by an incremental forming tool in accordance with an embodiment of the present invention.
Figure 7B:
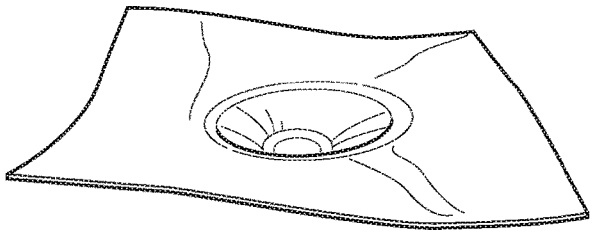
FIG. 7B is a perspective top view of the part formed by an incremental forming tool in accordance with an embodiment of the present invention.

FIGS. 6A and 6B are a perspective top view of a part formed by an incremental forming tool in accordance with an embodiment of the present invention and by a conventional incremental forming tool respectively. FIG. 7A is a bottom view of a part formed by an incremental forming tool in accordance with an embodiment of the present invention, while FIG. 7B is a perspective top view of the part formed by an incremental forming tool in accordance with an embodiment of the present invention.

Figure 8:
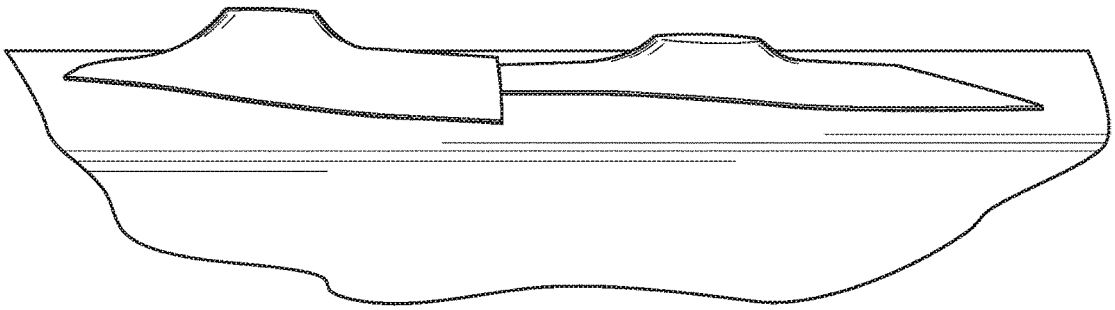
FIG. 8 is a side view of a part formed by an incremental forming tool in accordance with an embodiment of the present invention on the left next to a part formed by a conventional incremental forming tool on the right for a side-by-side comparison.

As shown in FIG. 8, on the left is a part that is formed using the new tooling geometry, while on the right is a part that is formed using a conventional forming tool. The truncated volcano-shaped part on the left is significantly higher than the part on the right. The angle between the sloped side of the volcano-shaped part and the horizon is about 55 degrees, while the corresponding angle on the part on the right is only about 44 degrees.

Figure 9:
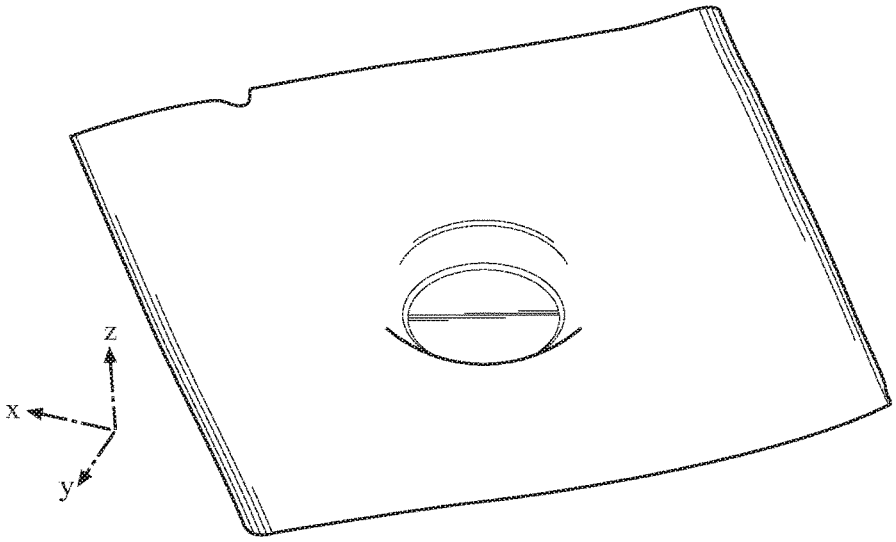
FIG. 9 is a schematic showing formability of a part formed by a conventional forming tool.
Figure 10:
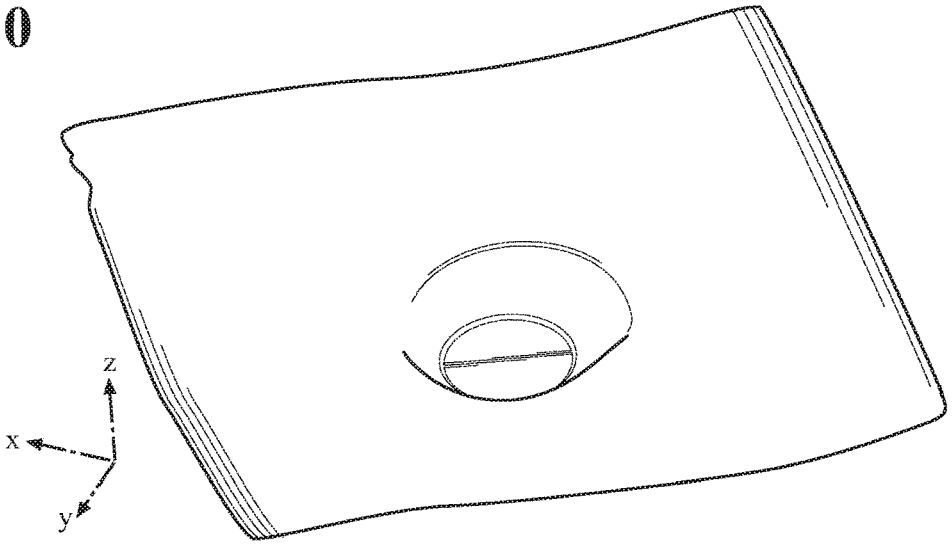
FIG. 10 is a schematic showing formability of a part formed by an incremental forming tool in accordance with an embodiment of the present invention.
Figure 11:
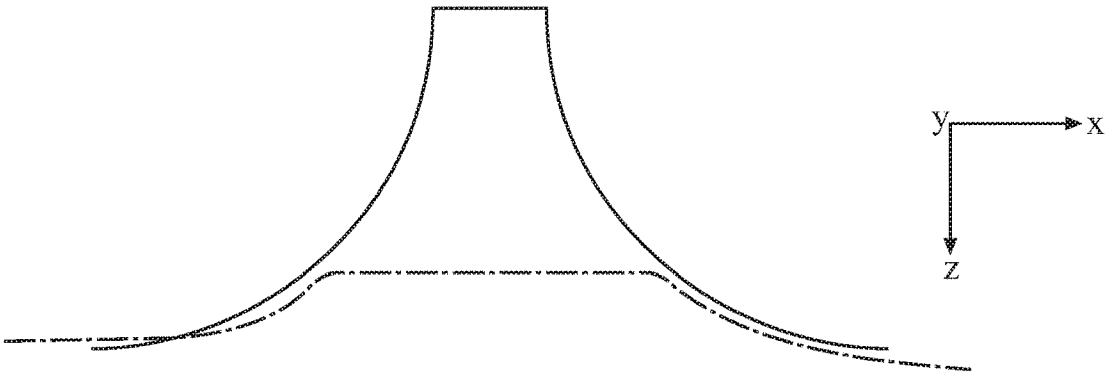
FIG. 11 is a formability profile of a part formed by a conventional forming tool comparing to a model profile.
Figure 12:
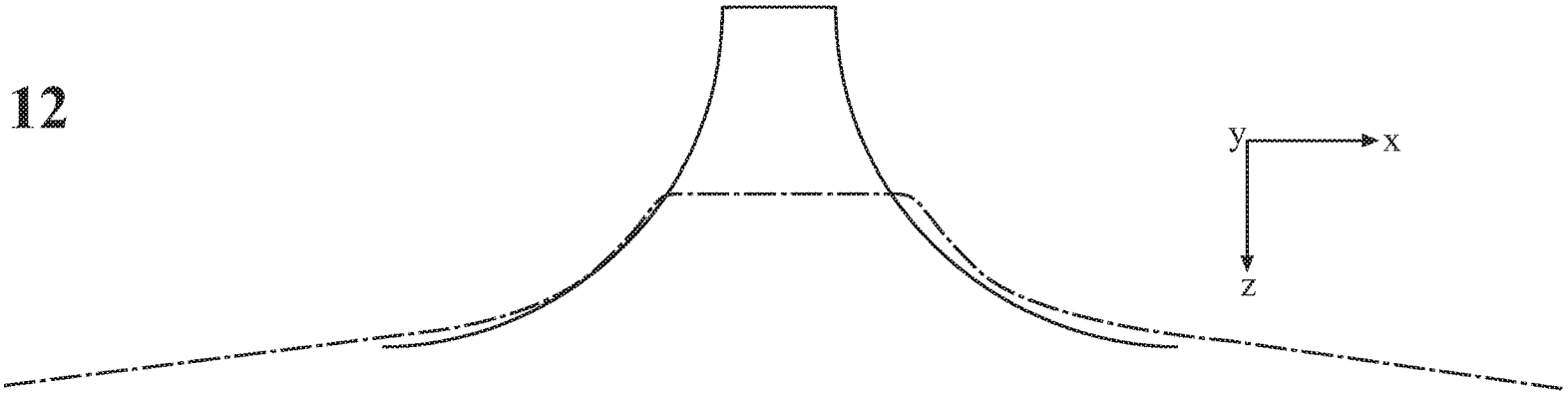
FIG. 12 is a formability profile of a part formed by an incremental forming tool in accordance with an embodiment of the present invention comparing to a model profile.
Figure 13:
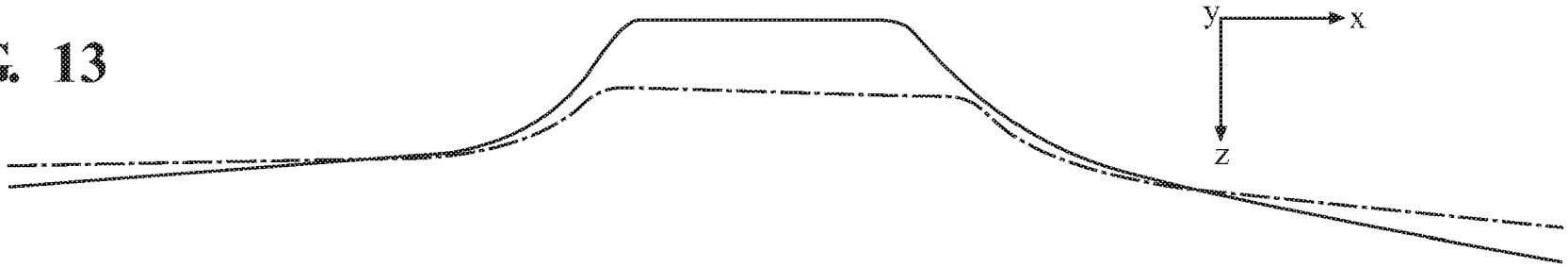
FIG. 13 is a formability profile of a part formed by an incremental forming tool in accordance with an embodiment of the present invention comparing to that of a scanned part formed by a conventional forming tool.

FIG. 9 shows formability of a part formed by a conventional forming tool, while FIG. 10 shows formability of a part formed by an incremental forming tool in accordance with an embodiment of FIGS. 2A-2D, which is deeper and wider than a part formed by a conventional forming tool. FIG. 11 is a formability profile of a part formed by a conventional forming tool, shown in dashed line, comparing to a CAD model profile, which is shown in a solid line. FIG. 12 is a formability profile of a part formed by an incremental forming tool in accordance with an embodiment of the present invention, shown in dashed line, comparing to a model profile, shown in solid line. FIG. 13 is a formability profile of a part formed by an incremental forming tool in accordance with an embodiment of the present invention, shown in solid line, comparing to that of a part formed by a conventional forming tool with a single contact point, shown in dashed line.

It can be seen that the new tooling geometry results in a part that has achieved significantly greater deformation than was achieved by the conventional tool. As shown in FIG. 11, in this example, it appears to be approximately more than double the formability.

FIG. 32 is a table listing showing springback analysis utilizing the tool shown in FIGS. 2A-2D. The table shows the relationship between the rotation speed of the tool and the percentage of springback elimination. These values are based off of springback reduction from baseline testing which utilized a conventional tool.

FIG. 33 is a table listing showing formability analysis utilizing the tool shown in FIGS. 2A-2D. The table shows the relationship between the rotation speed of the tool and maximum forming angle. Zero RPM indicates baseline testing conducted with a conventional tool.

Figure 14A:
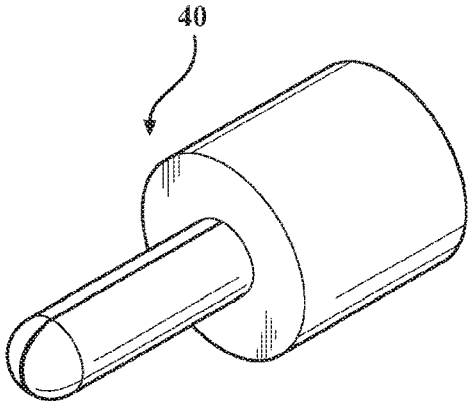
FIG. 14A is a perspective view of a split tool made by mating two halves of a hemisphere together at different heights in accordance with an embodiment of the present invention.
Figure 14B:
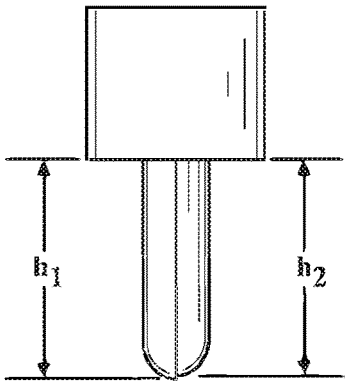
FIG. 14B is a side view of a split tool made by mating two halves of a hemisphere together at different heights in accordance with an embodiment of the present invention shown in FIG. 14A.
Figure 14C:
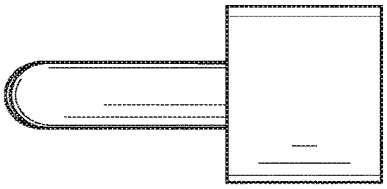
FIG. 14C is another side view of a split tool made by mating two halves of a hemisphere together at different heights in accordance with an embodiment of the present invention shown in FIG. 14A.
Figure 14D:
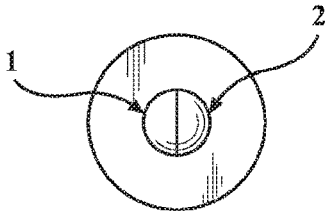
FIG. 14D is an end view of a split tool made by mating two halves of a hemisphere together at different heights in accordance with an embodiment of the present invention shown in FIG. 14A.
Figure 15A:
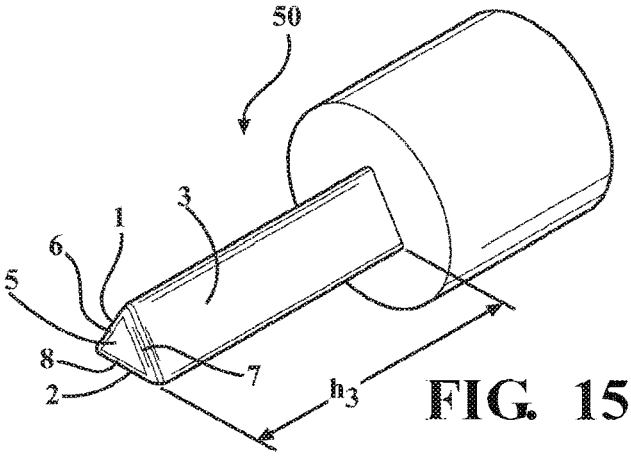
FIG. 15A is a perspective view of an incremental forming tool with a triangular shape in accordance with an embodiment of the present invention.
Figure 15B:
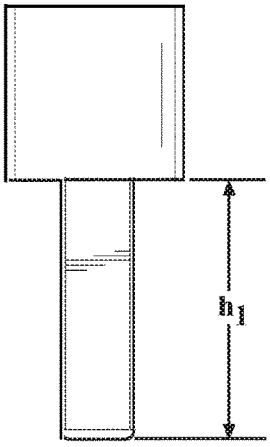
FIG. 15B is a side view of an incremental forming tool with a triangular shape in accordance with an embodiment of the present invention shown in FIG. 15A.
Figure 15C:
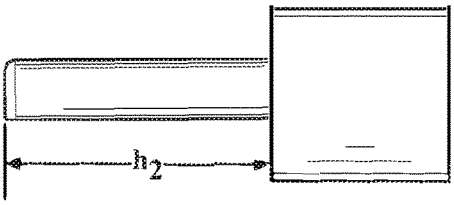
FIG. 15C is another side view of an incremental forming tool with a triangular shape in accordance with an embodiment of the present invention shown in FIG. 15A.
Figure 15D:
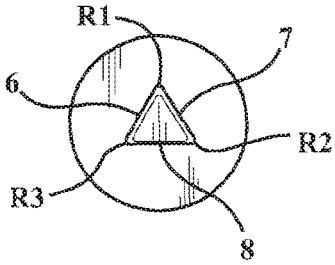
FIG. 15D is an end view of an incremental forming tool with a triangular shape in accordance with an embodiment of the present invention shown in FIG. 15A.
Figure 16A:
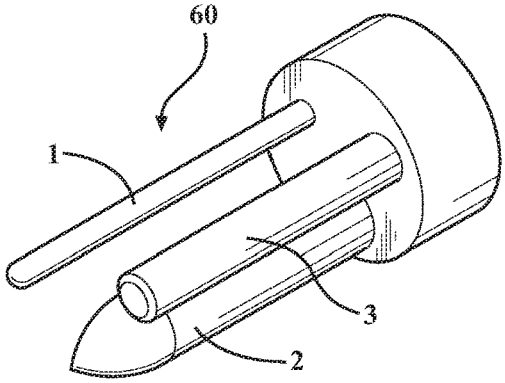
FIG. 16A is a perspective view of an incremental forming tool with three tool rods having various heights and shapes in accordance with an embodiment of the present invention.
Figure 16B:
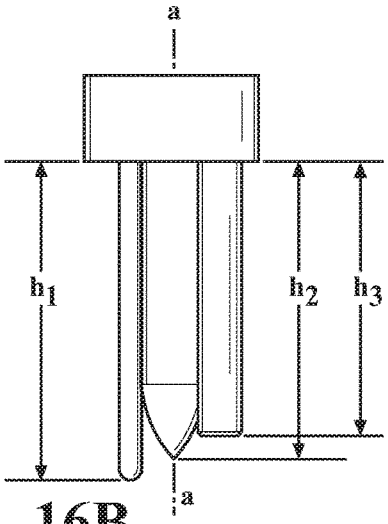
FIG. 16B is a side view of an incremental forming tool with three tool rods having various heights and shapes in accordance with an embodiment of the present invention shown in FIG. 16A.
Figure 16C:
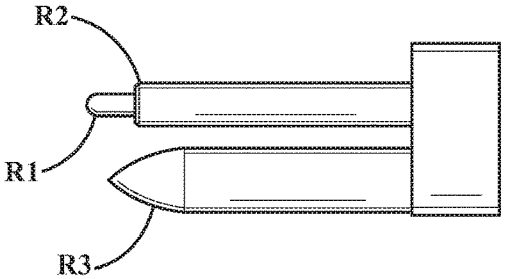
FIG. 16C is another side view of an incremental forming tool with three tool rods having various heights and shapes in accordance with an embodiment of the present invention shown in FIG. 16A.
Figure 16D:
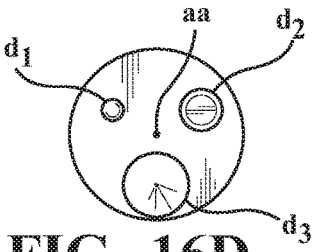
FIG. 16D is an end view of an incremental forming tool with three tool rods having various heights and shapes in accordance with an embodiment of the present invention shown in FIG. 16A.
Figure 17A:
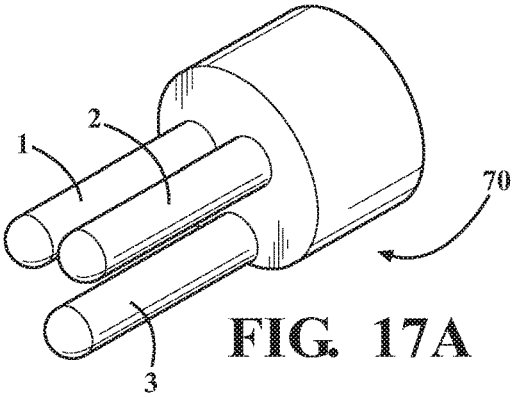
FIG. 17A is a perspective view of an incremental forming tool with three tool rods having various radial distances from the center of the tool holder in accordance with an embodiment of the present invention.
Figure 17B:
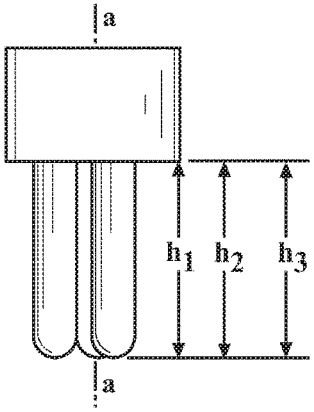
FIG. 17B is a side view of an incremental forming tool with three tool rods having various radial distances from the center of the tool holder in accordance with an embodiment of the present invention shown in FIG. 17A.
Figure 17C:
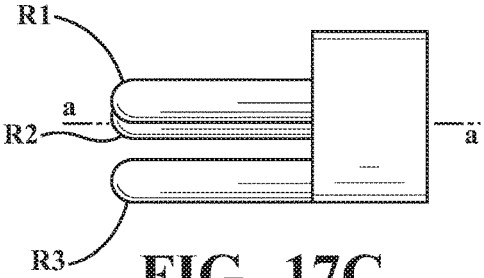
FIG. 17C is another side view of an incremental forming tool with three tool rods having various radial distances from the center of the tool holder in accordance with an embodiment of the present invention shown in FIG. 17A.
Figure 17D:
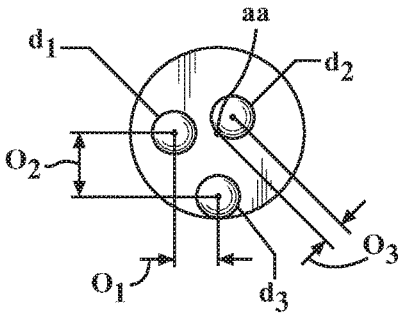
FIG. 17D is an end view of an incremental forming tool with three tool rods having various radial distances from the center of the tool holder in accordance with an embodiment of the present invention shown in FIG. 17A.
Figure 20A:
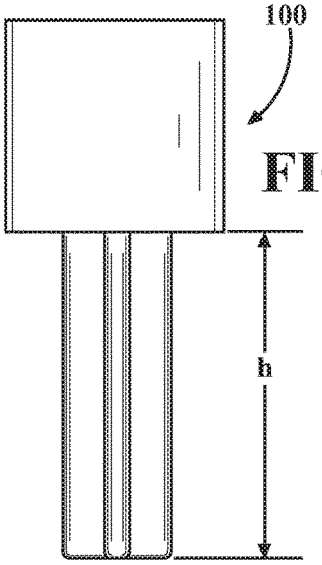
FIG. 20A is a side view of an incremental forming tool with a 4-petal clover-leaf shaped tool rod in accordance with an embodiment of the present invention.
Figure 20B:
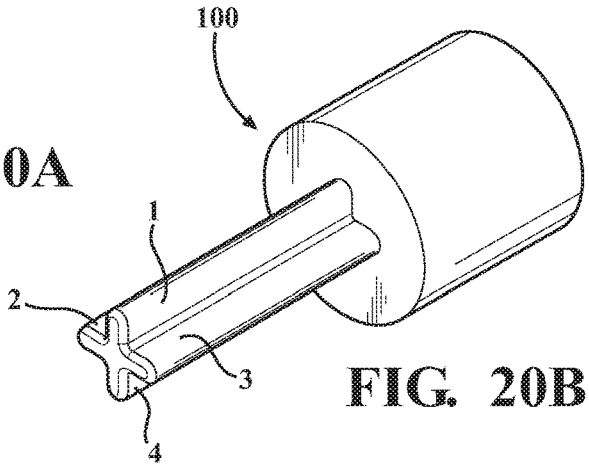
FIG. 20B is a perspective view of an incremental forming tool with a 4-petal clover-leaf shaped tool rod in accordance with an embodiment of the present invention shown in FIG. 20A.
Figure 20C:
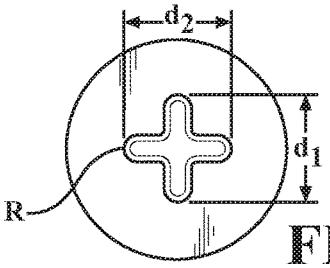
FIG. 20C is an end view of an incremental forming tool with a 4-petal clover-leaf shaped tool rod in accordance with an embodiment of the present invention shown in FIG. 20A.
Figure 20D:
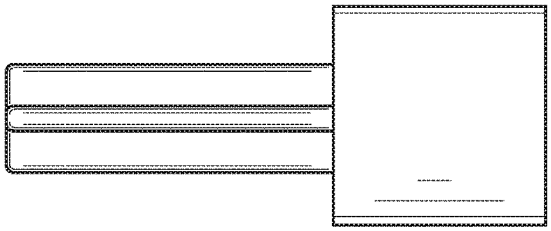
FIG. 20D is another side view of an incremental forming tool with a 4-petal clover-leaf shaped tool rod in accordance with an embodiment of the present invention shown in FIG. 20A.
Figure 21A:
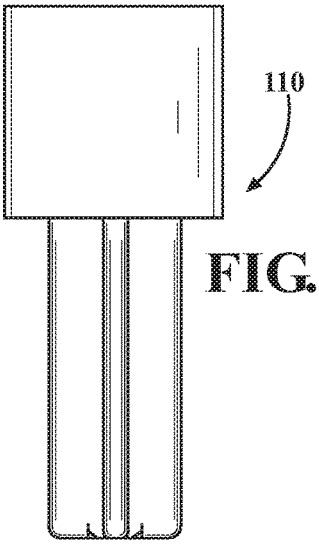
FIG. 21A is a side view of an incremental forming tool with a 4-petal clover-leaf shaped tool rod with various leaf lengths in accordance with an embodiment of the present invention.
Figure 21B:
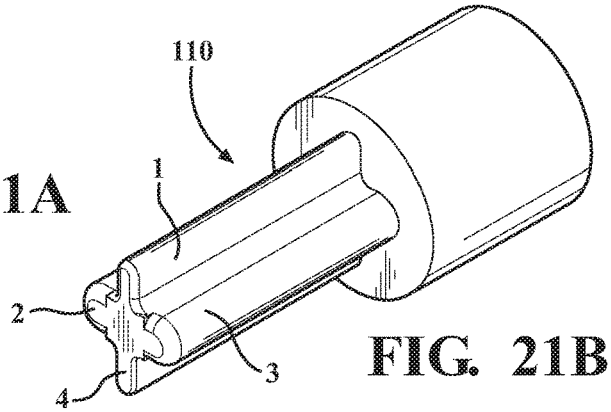
FIG. 21B is a perspective view of an incremental forming tool with a 4-petal clover-leaf shaped tool rod with various leaf lengths in accordance with an embodiment of the present invention shown in FIG. 21A.
Figure 21C:
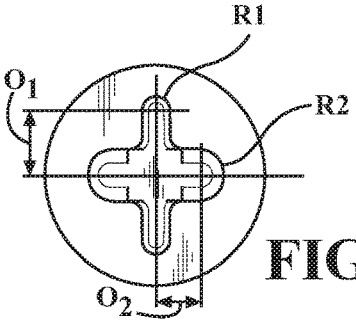
FIG. 21C is another side view of an incremental forming tool with a 4-petal clover-leaf shaped tool rod with various leaf lengths in accordance with an embodiment of the present invention shown in FIG. 21A.
Figure 21D:
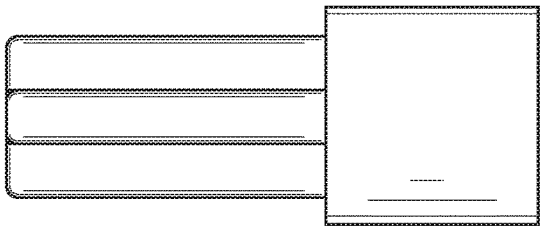
FIG. 21D is an end view of an incremental forming tool with a 4-petal clover-leaf shaped tool rod with various leaf lengths in accordance with an embodiment of the present invention shown in FIG. 21A.
Figure 22A:
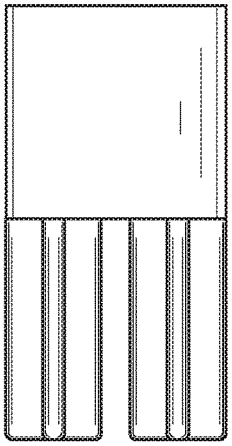
FIG. 22A is a side view of an incremental forming tool having multiple clover-leaf shaped tool rods in a single tool holder.
Figure 22B:
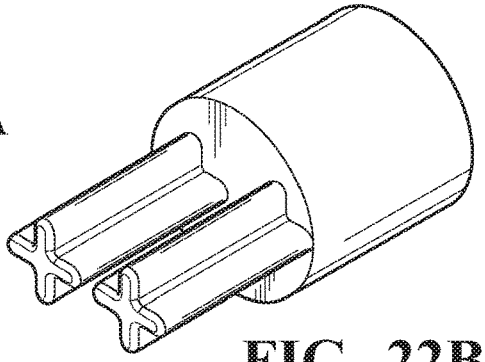
FIG. 22B is a perspective view of an incremental forming tool having multiple clover-leaf shaped tool rods in a single tool holder shown in FIG. 22A.
Figure 22C:
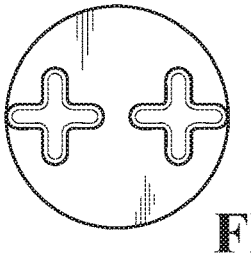
FIG. 22C is an end view of an incremental forming tool having multiple clover-leaf shaped tool rods in a single tool holder shown in FIG. 22A.
Figure 22D:
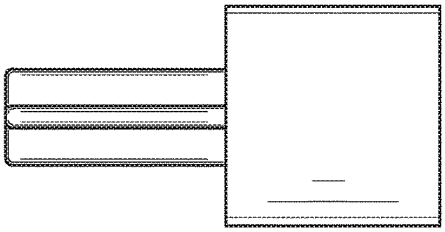
FIG. 22D is another side view of an incremental forming tool having multiple clover-leaf shaped tool rods in a single tool holder shown in FIG. 22A.
Figure 23A:
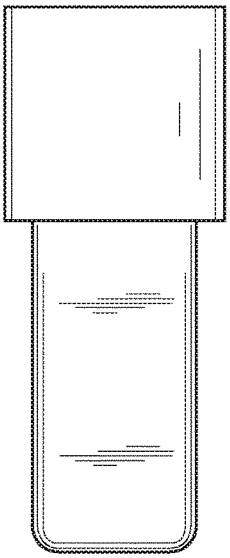
FIG. 23A is a side view of an incremental forming tool with an oval-shaped tool rod in accordance with an embodiment of the present invention.
Figure 23B:
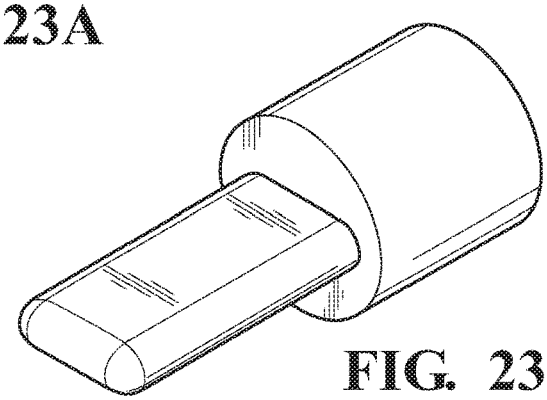
FIG. 23B is a perspective view of an incremental forming tool with an oval-shaped tool rod in accordance with an embodiment of the present invention shown in FIG. 23A.
Figure 23C:
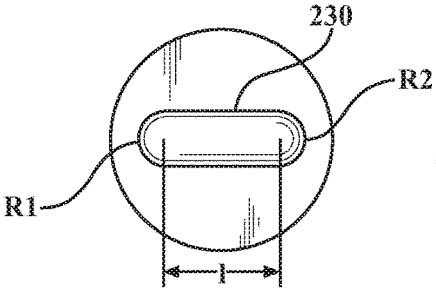
FIG. 23C is an end view of an incremental forming tool with an oval-shaped tool rod in accordance with an embodiment of the present invention shown in FIG. 23A.
Figure 23D:
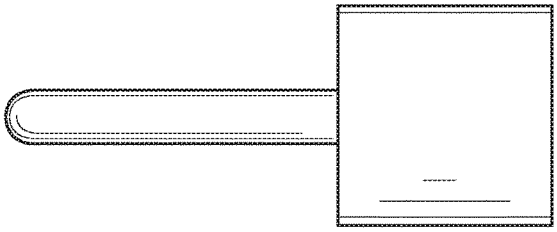
FIG. 23D is another side view of an incremental forming tool with an oval-shaped tool rod in accordance with an embodiment of the present invention shown in FIG. 23A.
Figure 24A:
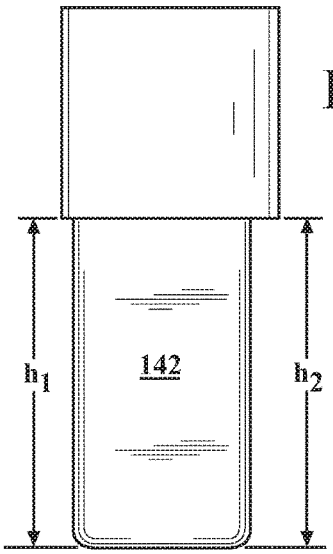
FIG. 24A is a side view of an incremental forming tool having an oval-shaped tool rod with various radii on each end of the oval in accordance with an embodiment of the present invention.
Figure 24B:
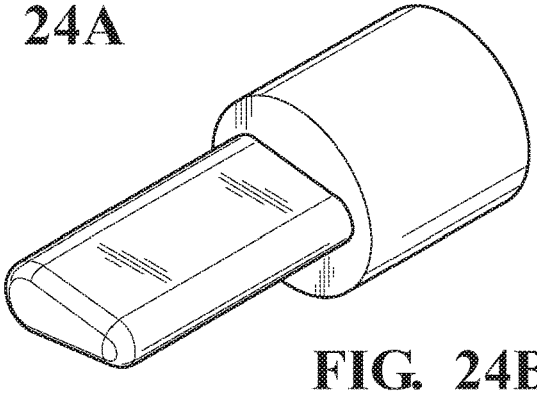
FIG. 24B is a perspective view of an incremental forming tool having an oval-shaped tool rod with various radii on each end of the oval in accordance with an embodiment of the present invention shown in FIG. 24A.
Figure 24C:
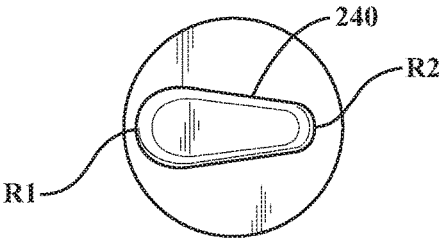
FIG. 24C is an end view of an incremental forming tool having an oval-shaped tool rod with various radii on each end of the oval in accordance with an embodiment of the present invention shown in FIG. 24A.
Figure 24D:
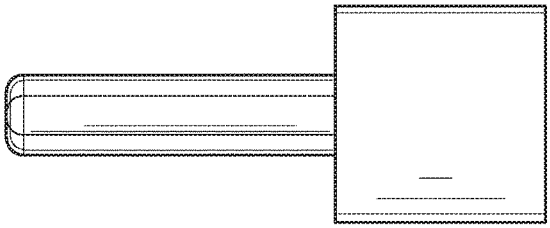
FIG. 24D is another side view of an incremental forming tool having an oval-shaped tool rod with various radii on each end of the oval in accordance with an embodiment of the present invention shown in FIG. 24A.
Figure 25A:
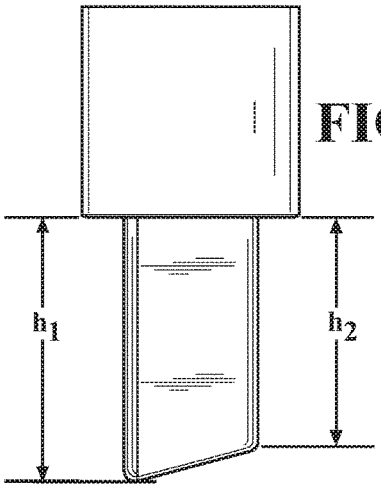
FIG. 25A is a side view of an incremental forming tool having an oval-shaped tool rod with various radii and heights on each end of the oval in accordance with an embodiment of the present invention.
Figure 25B:
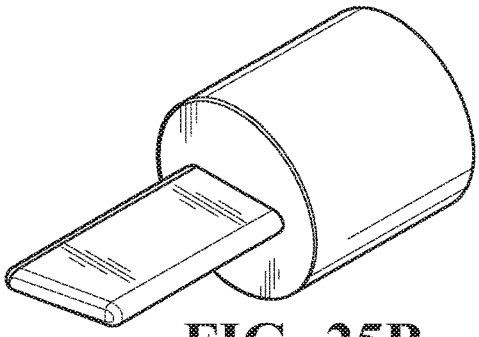
FIG. 25B is a perspective view of an incremental forming tool having an oval-shaped tool rod with various radii and heights on each end of the oval in accordance with an embodiment of the present invention shown in FIG. 25A.
Figure 25C:
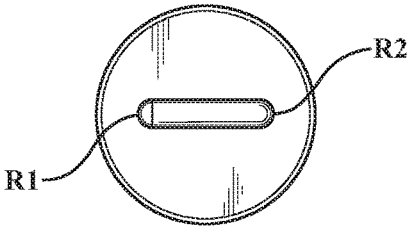
FIG. 25C is an end view of an incremental forming tool having an oval-shaped tool rod with various radii and heights on each end of the oval in accordance with an embodiment of the present invention shown in FIG. 25A.
Figure 25D:
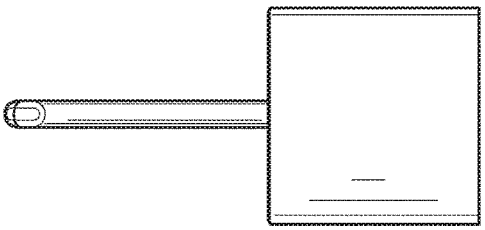
FIG. 25D is another side view of an incremental forming tool having an oval-shaped tool rod with various radii and heights on each end of the oval in accordance with an embodiment of the present invention shown in FIG. 25A.
Figure 26A:
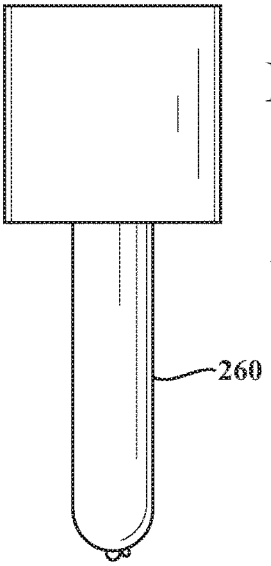
FIG. 26A is a side view of an incremental forming tool with a number of bumps around a spherical tip in accordance with an embodiment of the present invention.
Figure 26B:
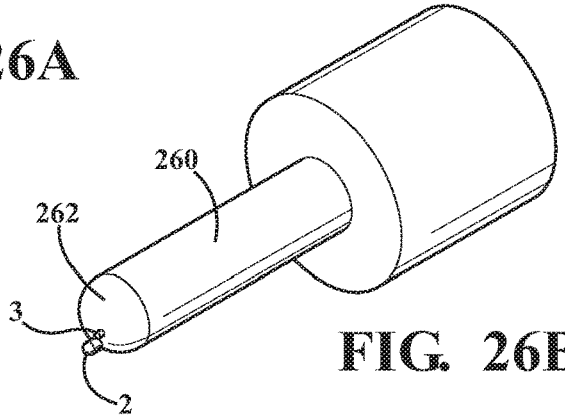
FIG. 26B is a perspective view of an incremental forming tool with a number of bumps around a spherical tip in accordance with an embodiment of the present invention shown in FIG. 26A.
Figure 26C:
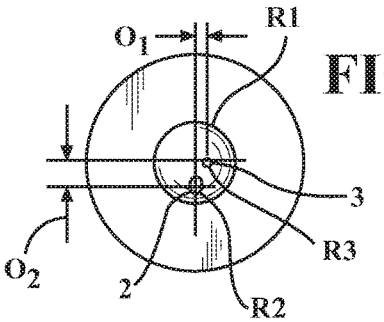
FIG. 26C is an end view of an incremental forming tool with a number of bumps around a spherical tip in accordance with an embodiment of the present invention shown in FIG. 26A.
Figure 26D:
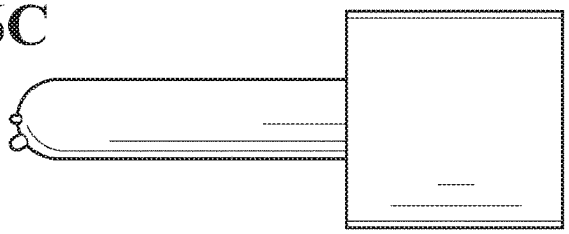
FIG. 26D is another side view of an incremental forming tool with a number of bumps around a spherical tip in accordance with an embodiment of the present invention shown in FIG. 26A.
Figure 27A:
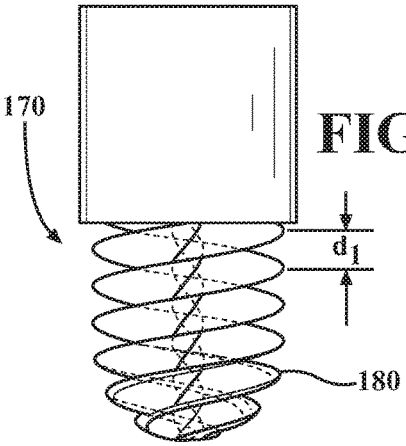
FIG. 27A is a side view of an incremental forming tool with a spiral tool rod in accordance with an embodiment of the present invention.
Figure 27B:
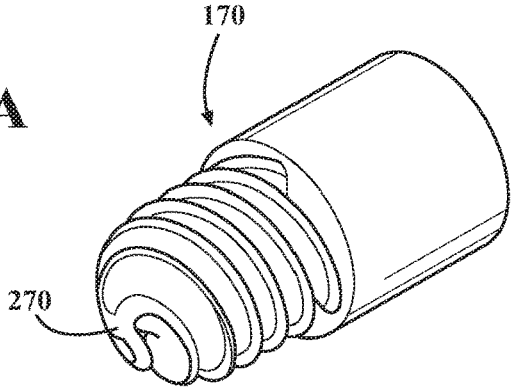
FIG. 27B is a perspective view of an incremental forming tool with a spiral tool rod in accordance with an embodiment of the present invention shown in FIG. 27A.
Figure 27C:
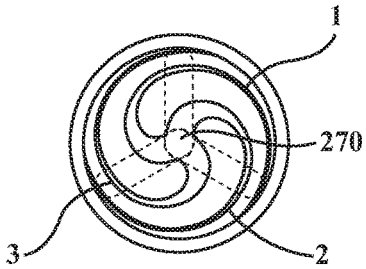
FIG. 27C is an end view of an incremental forming tool with a spiral tool rod in accordance with an embodiment of the present invention shown in FIG. 27A.
Figure 27D:
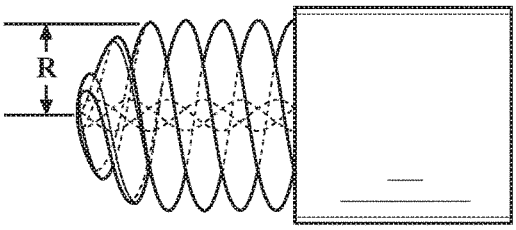
FIG. 27D is a side view of an incremental forming tool with a spiral tool rod in accordance with an embodiment of the present invention shown in FIG. 27A.
Figure 28A:
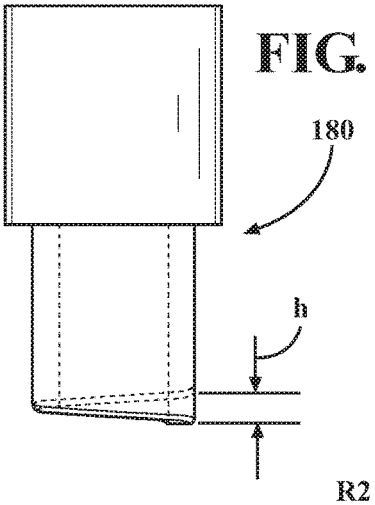
FIG. 28A is a side view of an incremental forming tool with a spiral tool rod in accordance with another embodiment of the present invention.
Figure 28B:
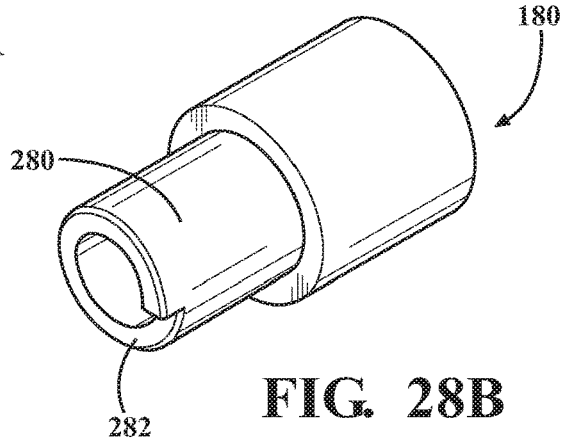
FIG. 28B is a perspective view of an incremental forming tool with a spiral tool rod in accordance with another embodiment of the present invention shown in FIG. 28A.
Figure 28C:
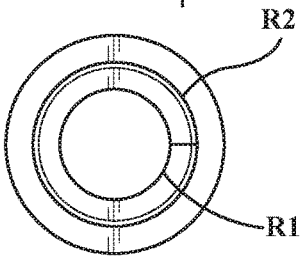
FIG. 28C is an end view of an incremental forming tool with a spiral tool rod in accordance with another embodiment of the present invention shown in FIG. 28A.
Figure 28D:
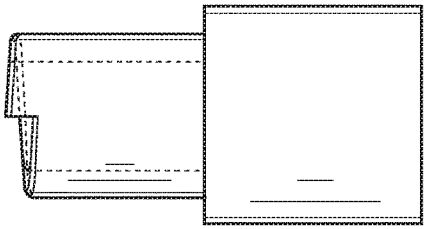
FIG. 28D is another side view of an incremental forming tool with a spiral tool rod in accordance with another embodiment of the present invention shown in FIG. 28A.
Figure 29A:
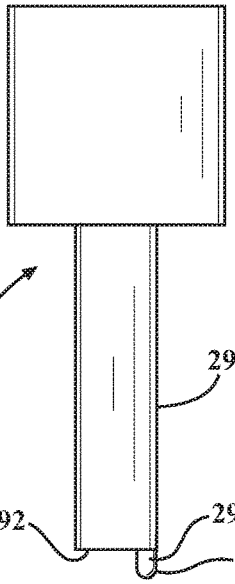
FIG. 29A is a side view of an incremental forming tool with an offset point on the tip of the rod in accordance with another embodiment of the present invention.
Figure 29B:
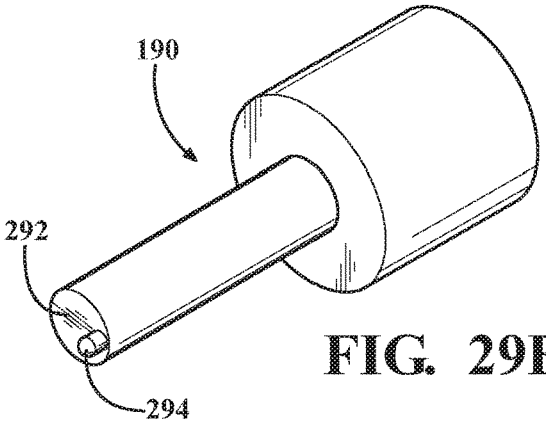
FIG. 29B is a perspective view of an incremental forming tool with an offset point on the tip of the rod in accordance with another embodiment of the present invention shown in FIG. 29A.
Figure 29C:
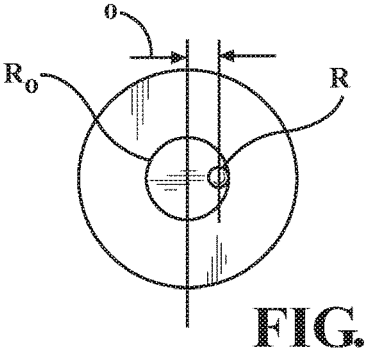
FIG. 29C is an end view of an incremental forming tool with an offset point on the tip of the rod in accordance with another embodiment of the present invention shown in FIG. 29A.
Figure 29D:
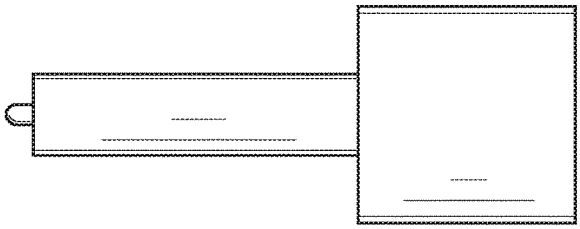
FIG. 29D is another side view of an incremental forming tool with an offset point on the tip of the rod in accordance with another embodiment of the present invention shown in FIG. 29A.

FIGS. 14A-14D illustrates an embodiment of an incremental forming tool 40 made by mating two halves of a cylinder 1 and 2 together. This type of incremental forming tool can also be called a split tool. The heights of the two halves may vary. The amount of difference in heights may also vary and/or be adjustable. In one example, the height of one half $h_1$ is 1.25 inches, while the height of the other half $h_2$ is 1.2350 inches. In one example, the two halves have the same radius, as shown in FIG. 14D. In another example, the radii of two halves may be different and, as a result, the heights of two tool rods may be different. The heights may also be different while the radii are the same. There may also be more sections of the tool made by splitting the tool into thirds, fourths, etc. rather than in half.

In another embodiment, the incremental forming tool may be made from a solid polygon shape. The number of sides of the polygon may be varied. FIGS. 15A-15D illustrate a tool 50 with a tool rod of a triangular shape having three sides 1, 2 and 3, three edges 6, 7, and 8 at the tool tip 5. The radius on edges 6, 7, and 8 of the polygon R1 R2 and R3 may be varied. The height of each side of the polygon can vary, essentially creating a slanted tool tip 5. In one example, the radius on two edges of the triangle is each 0.0156 inches, while the radius of the third edge is 0.0325 inches.

In yet another embodiment, the tool may have more than two rods. The diameter of each rod may vary or may be typical. The height of each rod may vary or may be typical. The radius of each head may vary or may be typical. The rods may have same or different shapes. The radial distance of each rod from the center of the tool holder can be varied. FIGS. 17A-17D illustrate a tool 70 having three rods 1, 2 and 3 with the same shape, the same diameter and the same radius but different radial offset from the axis of the tool holder. In one example, the heights $h_1$, $h_2$ and $h_3$ each are 1.75 inches. The diameters $d_1$, $d_2$ and $d_3$ each are 0.3750 inches. The radius of each head $R_1$, $R_2$ and $R_3$ is 0.1875 inches. However, the offset of tool rods $O_1$ and $O_2$ are 0.3750 inches and 0.5625 respectively. The radial offset $O_3$ is 0.1875 inches. The incremental forming tool embodied in FIGS. 17A-17D creates a three-point contact between the tool rods 1, 2 and 3 and a sheet material. During the incremental forming, the tool rods 1, 2 and 3 rotate about the axis aa of the tool holder such that three contact points simulate oscillating in and out and/or side-to-side while forming, thereby reducing or eliminating ridges and creating a smoother surface on the sheet material. If the tool rods are of the different heights as well, then simulation of oscillation in all three dimensional directions would be achieved. The elimination of ridges is a result of the rotating motion of the tool rods causing forming along the wall of the part to be broken up; i.e. the conventional toolpath creates a line about the formed geometry from continuous forming, the new tool is able to diminish the visibility of a line by essentially spreading the contact points along the formed wall of the part. Both of these effects are present and improve the measured surface. This is especially true when the next tool path crosses the same location (one step down) and has cross-over effects with the previous pass, further smoothing the surface if the tool rods are of different heights.

FIGS. 16A-16D illustrate a tool 60 having three rods 1, 2 and 3 with different heights, diameters and radii. In one example, the heights $h_1$, $h_2$ and $h_3$ each are 1.8750 inches, 1.7500 inches and 1.6000 inches respectively. The diameters $d_1$, $d_2$ and $d_3$ each are 0.1250 inches, 0.2500 inches and 0.3750 inches respectively. The radius of each head $R_1$, $R_2$ and $R_3$ are 0.0625 inches, 0.0313 inches and 0.7500 inches respectively. The incremental forming tool embodied in FIGS. 16A-16D creates a three-point contact between the tool rods 1, 2 and 3 and a sheet material. During the incremental forming, the tool rods 1, 2 and 3 rotate about the axis aa of the tool holder such that three contact points simulate oscillating up and down, in and out, and/or side-to-side while forming, due to the differences of the heights as well as the diameters, and thus the offsets of tool rods, thereby reducing or eliminating ridges and creating a smoother surface on the sheet material. The various radii act to contact the formed wall in various locations, improving the smoothing effect of the tool. It is noted that this is an example of possible dimensions to use in creating a tool. However, all dimensions, including but not limited to heights and offsets, may be changed depending on part-specific parameters.

FIGS. 18A-18D illustrate a tool 80 having four rods 1, 2, 3, and 4, rather than three. The heights, diameters, radii or shapes of the rods may be typical or may vary. The incremental forming tool embodied in FIGS. 18A-18D creates a four-point contact between the tool rods 1, 2, 3 and 4 and a sheet material.

In another embodiment, the rod of the tool can have a clover-leaf shape. There may be three, four or more clover-leaf petals. Each petal may have varying height, varying diameter or varying radius. FIGS. 19A-19D show a tool 90 with a 3-petal clover-leaf rod 1, 2, and 3 having varying heights $h_1$, $h_2$ and $h_3$. In one example, the heights of two petals $h_1$ and $h_2$ are 1.1938 inches and 1.0757 respectively.

FIGS. 20A-20D illustrate a tool 100 with a clover-leaf shaped rod having four petals (legs) 1, 2, 3, and 4 with the typical height h, dimension d1, d2 and radius R. In one example, the height h is 1.50 inches. The dimensions $d_1$ and $d_2$ each are 0.50 inches. The radius R of each petal is 0.03. However, each height, dimension and radius may vary. The legs of the clover can extend different lengths, i.e., the heights of petals (legs) 1, 2, 3 and 4 may be different from one another, thereby creating a slanted head. The thickness of each leg can be different. The thickness may be the same as the diameter of the end or may be different. Both the end radius and bottom radius of each leg may be different. The axial length of each petal from the center of the tool rod may be different.

FIGS. 21A-21D show a tool 110 with a clover-leaf shaped tool rod having four petals 1, 2, 3, and 4 with the typical height but dimensions $O_1$ and $O_2$ of each clover leaf section may be varied. The radius $R_1$ and $R_2$ at the end of each petal may be varied. The radius of the head of the rod may also be varied. In one example, the dimensions $O_1$ and $O_2$ are 0.3125 inches and 0.1875 inches respectively. The radius $R_1$ and $R_2$ are 0.0625 inches and 0.1250 inches respectively. Multiple clover-leaf tools can be used in a single tool holder. FIG. 22 illustrates a tool with two clover-leaf rods in a single tool holder.

In yet another embodiment, the tool rod can have an elliptical or oval shape, as illustrated in FIGS. 23A-23D, 24A-24D and 25A-25D. The height and radius of each end may be typical or may vary. The dimension of the oval shape may be varied. In one example, for the embodiment shown in FIGS. 23A-23D, the dimension d of the oval shape 230 is 0.5000 inches. The radius $R_1$ and $R_2$ at each end of the oval shape are each 0.1250 inches. Similarly, for the embodiment shown in FIGS. 24A-24D, the heights $h_1$ and $h_2$ of the tool rod 142 on two ends 1 and 2 of the oval shape 240 are the same, but the radius at each end of the oval shape is not the same. In one example, for the embodiment shown in FIGS. 24A-24D, the radius $R_1$ and $R_2$ are 0.19 inches and 0.13 inches respectively. For the embodiment shown in FIGS. 25A-25D, in one example, the height $h_1$ and $h_2$ each are 1.2298 inches and 1.0875 inches respectively. The radius $R_1$ and $R_2$ each are 0.0625 inches and 0.0313 respectively.

In another embodiment, a helically shaped tool 170 with rounded edges can be used, as shown in FIGS. 27A-27D. The radius of the tip 270 can vary or be eliminated. The pitch of the helical spiral $d_1$ can be varied. There can be any number of flutes (arms) on the tool. The radius R of the forming edge 180 can be varied. The flute may also extend different distance from the rotation point 270. In one example, the pitch of the helical spiral $d_1$ is 0.17 inches and the radius of the forming edge R is 0.44 inches. For the embodiment shown in FIG. 27C, there are three arms 1, 2 and 3.

The tools may feature a helical spiral 282 formed into the top of a cylinder 280, as shown in FIGS. 28A-28D. The cylinder 280 can be hollow or solid. The pitch h of the spiral can be varied. The thickness of the cylinder ($R_2$–$R_1$) can be varied. In one example, the pitch h is 0.1250 inches and the radius $R_1$ and $R_2$ each are 0.2500 inches and 0.3750 inches respectively.

It is noted here that these two tools, as embodied in FIGS. 27 and 28, would achieve similar results; however, the helix would be more difficult to manufacture than the cylinder. This shows how this type of tooling method can be tailored to match the manufacturing capabilities of its user.

The tools may also be wavy or have other contoured shapes that would cause the tool to essentially pulse up and down, in and out, and side-to-side.

The tool may have extra bumps or protrusions around it to cause the deformation to vary depending on location around the tool. The protrusions may vary in size, depth, location, radius, and other parameters.

Another embodiment is that the tool may have protrusions around the tool to cause varying deformation as the tool is rotated. These protrusions may be of varying size, shape, height or curvature. One embodiment of this concept can be found in FIGS. 26A-26D wherein two protrusions 2 and 3 are placed on the tip 262 of the tool rod 260 of a single shafted tool 160. These protrusions may be added to the profile of any other embodiment shown or described herein.

In FIGS. 26A-26D, a round tool 160 with bumps 2 and 3 made around the spherical head 262 is illustrated. The bumps can be of any radius, height and location on the head. There can be any number of bumps, placed in a pattern or randomly on the tool. In one example, the radius $R_1$ of the cylindrical rod 260 is 0.3750 inches and the radius $R_2$ and $R_3$ of two bumps 2 and 3 are 0.0313 inches and 0.0156 inches respectively. The offset $O_1$ and $O_2$ are 0.0553 inches and 0.1071 inches respectively.

FIGS. 29A-29D illustrate a tool 190 with a cylindrical tool rod 290 having a flat head 292 with a projection 294 near a side of the flat head 292. In one example, the offset O is 0.1406 inches. In this example, the radius $R_0$ of the cylindrical rod 290 is 0.0938 inches and the radius R of the projection 294 is 0.0469 inches.

These bumps illustrated in FIGS. 26A-26D and 29A-29D can be added to other embodiments of the tool.

Figure 30A:
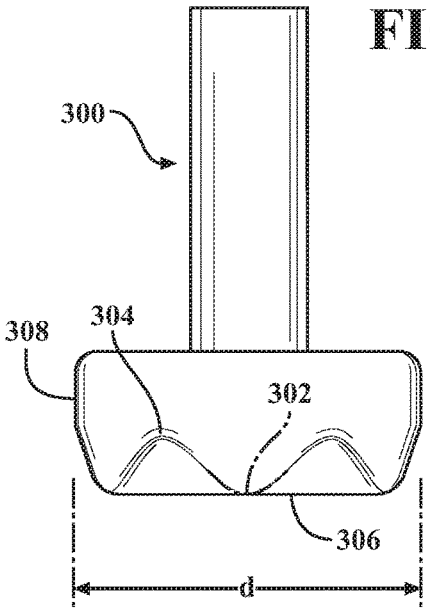
FIG. 30A is a side view of an incremental forming tool with a forming portion of a vertical sine wave in accordance with an embodiment of the present invention.
Figure 30B:
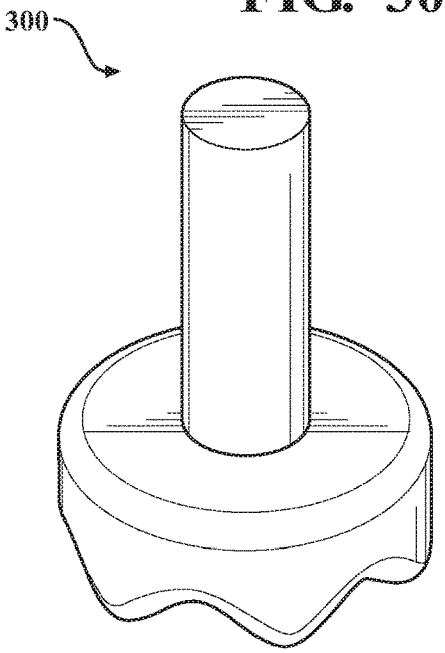
FIG. 30B is a perspective view of an incremental forming tool with a forming portion of a vertical sine wave in accordance with an embodiment of the present invention.
Figure 31A:
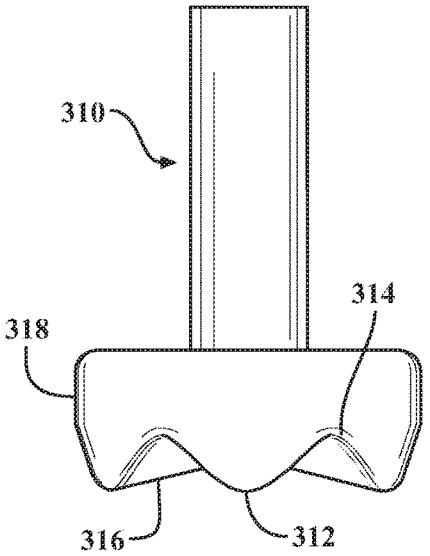
FIG. 31A is a side view of an incremental forming tool with a forming portion of a vertical sine wave in accordance with another embodiment of the present invention.
Figure 31B:
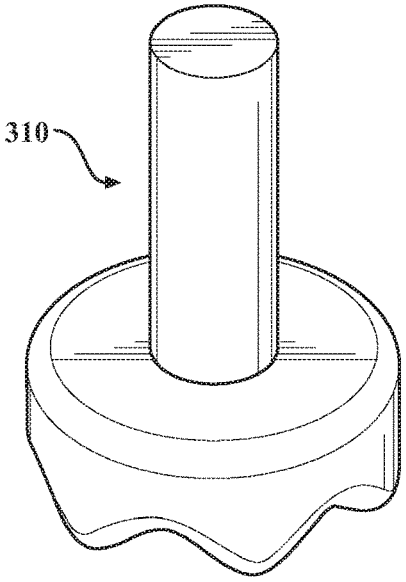
FIG. 31B is a side view of an incremental forming tool with a forming portion of a vertical sine wave in accordance with another embodiment of the present invention.

FIGS. 30A-30B and FIGS. 31A-31B represent a variation of an incremental forming tool in accordance with the tooling concept of the present invention. As shown in FIGS. 30A and 30B, the forming portion 308 of this geometry is seen as a vertical sine wave. This wave may have any number of peaks 302 and troughs 304. The diameter d of the tool 300 can be changed. The central portion 306 of the forming tool can be in plane with the forming ends 302 of the tool, the forming ends being the furthest extensions of the tool rod, i.e., the peaks 302 in this case. In FIGS. 31A and 31B, a forming tool 310, similar to the tool 300 in FIGS. 30A-30B, is shown, with a forming portion 318 having a vertical sine wave geometry. This wave may have any number of peaks 312 and troughs 314. What is different from the tool 300, is that the central portion 316 of the forming tool 310 is raised relative to the forming ends 312 of the tool 310. The head of the tool rods may take any type of wave form having peaks and troughs other than a sine wave geometry.

Figure 35A:
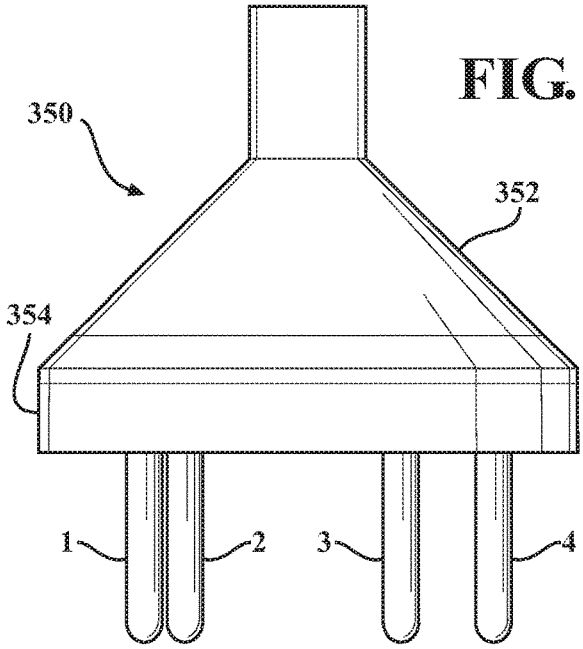
FIG. 35A is a side view of an incremental forming tool with rotating tool rods in accordance with an embodiment of the present invention.
Figure 35B:
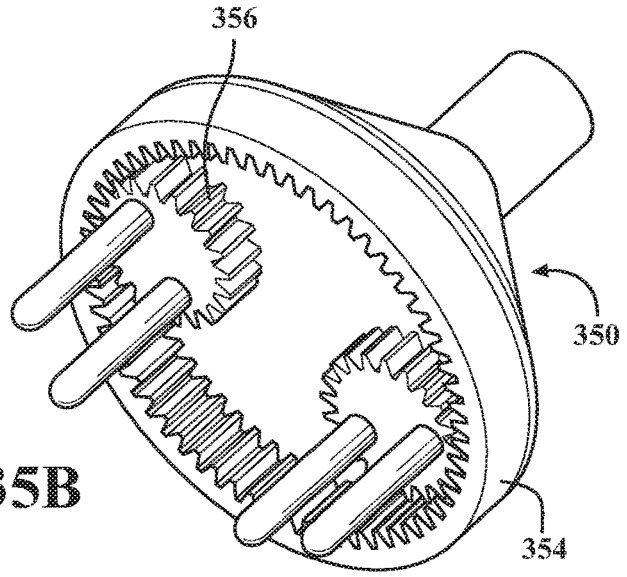
FIG. 35B is a perspective view of an incremental forming tool with rotating tool rods in accordance with an embodiment of the present invention.
Figure 35C:
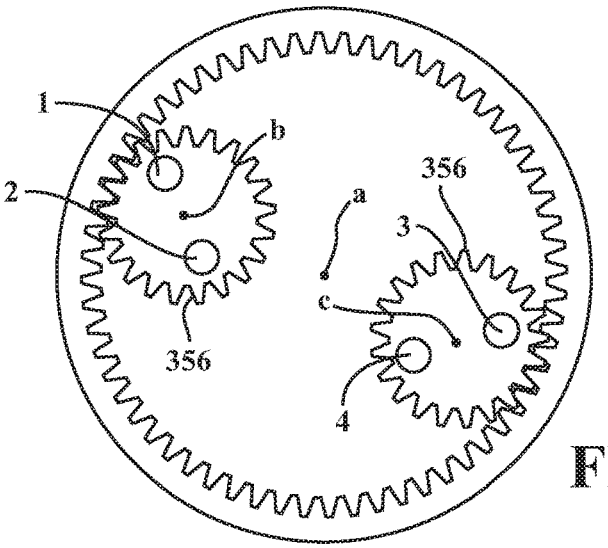
FIG. 35C is an end view of an incremental forming tool with rotating tool rods in accordance with an embodiment of the present invention.
Figure 36A:
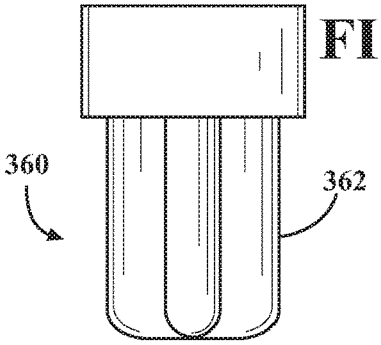
FIG. 36A is a side view of an incremental forming tool with a tool rod having an in-plane webbing tool tip in accordance with an embodiment of the present invention.
Figure 36B:
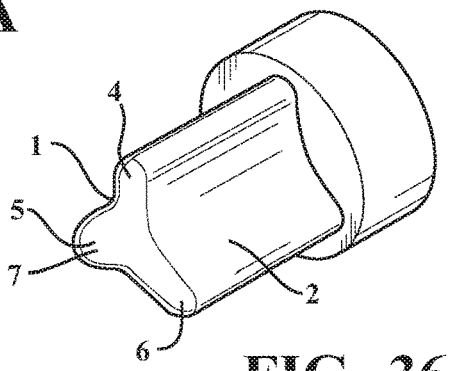
FIG. 36B is a perspective view of an incremental forming tool with a tool rod having an in-plane webbing tool tip in accordance with an embodiment of the present invention.
Figure 36C:
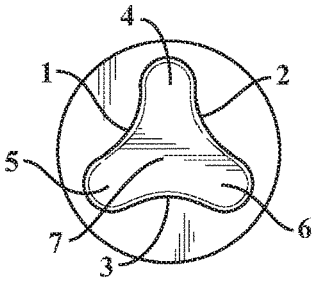
FIG. 36C is an end view of an incremental forming tool with a tool rod having an in-plane webbing tool tip in accordance with an embodiment of the present invention.
Figure 36D:
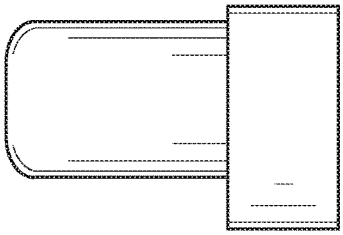
FIG. 36D is a side view of an incremental forming tool with a tool rod having an in-plane webbing tool tip in accordance with an embodiment of the present invention.
Figure 37A:
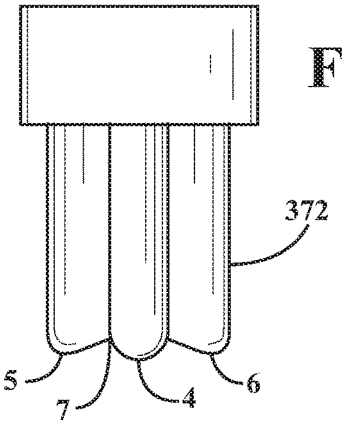
FIG. 37A is a side view of an incremental forming tool with a tool rod having an out-of-plane webbing tool tip in accordance with an embodiment of the present invention.
Figure 37B:
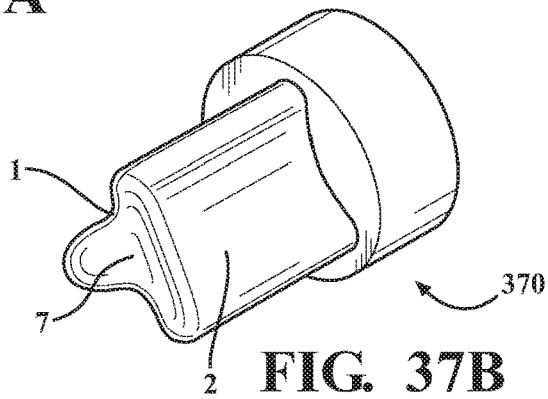
FIG. 37B is a perspective view of an incremental forming tool with a tool rod having an out-of-plane webbing tool tip in accordance with an embodiment of the present invention.
Figure 37C:
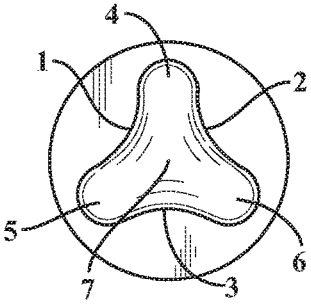
FIG. 37C is an end view of an incremental forming tool with a tool rod having an out-of-plane webbing tool tip in accordance with an embodiment of the present invention.
Figure 37D:
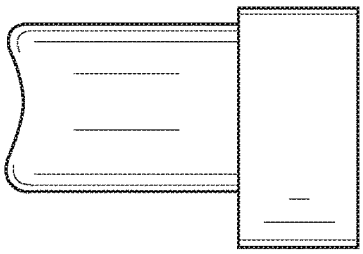
FIG. 37D is a side view of an incremental forming tool with a tool rod having an out-of-plane webbing tool tip in accordance with an embodiment of the present invention.

Forming can also be accomplished by rotating the tool heads about an axis which also revolves around a central axis of the tool. As shown in FIGS. 35A-35C, a tool 350 includes tool heads 1, 2, 3, and 4. There are two planet gears 356 mounted on a ring gear 354. The tool heads 1, 2 and 3, 4 are mounted on one of the planet gears 356 respectively. The ring gear 354 can rotate about its axis a. The planets gears 356 can each revolve about its own axis b, c respectively thereby causing the tool rods 1, 2, 3 and 4 revolve about their own planet gear axis while revolving about the ring gear axis a. The ring gear can be fixed or forced to rotate. The tool 350 can also rotate about the axis a or be fixed. Any number of tool heads may be added to the planet gears and in any configuration with various dimensions.

FIGS. 36A-36D depict a tool 360 having a polygonal tool rod 362 with a webbed tool tip 7. In one example, the tool 360 includes three concave sides 1, 2, 3. However, the tool rod 362 may have more than three sides. Each side may be concave or flat or convex. The webbed tool tip may also be convex, in-plane or concave. In this embodiment, the webbing is in-plane, meaning that the webbing is in the same plane as the forming ends 4, 5, 6, the forming ends being the furthest extensions of the tool rod 362.

The embodiment shown in FIGS. 37A-37D includes a polygonal tool rod 372 that is similar to the one in FIG. 36A-36D, having three sides 1, 2 and 3. The difference is that the webbing 7 is out of plane, i.e., concave relative to the forming ends 4, 5, 6. The webbing can be offset in either direction, meaning that it may be convex as well.

Basically, we are taking the simple rounded cylinder and adding different conditions to allow the surface scallops to be reduced and to allow the formation to be released and reapplied as the tool rotates. The concept is to have multiple forming locations contact the workpiece during each rotation of the tool.

The apparatus and methods described herein are presently representative of preferred embodiments, exemplary, and not intended as limitations on the scope of the invention. Changes therein and other uses will occur to those skilled in the art. Such changes and other uses can be made without departing from the scope of the invention as set forth in the claims.

The invention claimed is:

1. A method of incremental forming a part using a sheet material, the method comprising the steps of:

providing a tool holder having an axis and a base;

providing at least two tool rods mounted at the base of the tool holder, each tool rod having a head, a body, an offset from the axis and a height, the height being from the base to a tip of the head, the body having a cross-sectional shape and size, each head along with a portion of a side of each respective tool rod defining at least one forming end;

applying the at least two tool rods to the sheet material while rotating the at least two tool rods about the axis of the tool holder, the forming ends repeatedly contacting the sheet material at a contact area, the contact area on the sheet material experiencing an oscillating motion as the forming end of one of the tool rods and then the forming end of another of the tool rods alternatingly contact the contact area thereby creating an at least two-point contact;

and forming the sheet material with the forming ends of the tool rods.

2. A method according to claim 1, wherein at least one of a shape of the head, the height, the cross-sectional shape or the offset is different for each tool rod.

3. A method according to claim 1, wherein each tool rod body has a circular cross-section, the radii of one of the tool rods is different than another of the tool rods.

4. A method according to claim 1, wherein the body of each tool rod has a circular cross-sectional shape and the head of each tool rod is hemispherical.

5. A method according to claim 1, wherein the at least two tool rods include two tool rods, the cross-sectional shape of each tool rod body being half-circular, the head of each rod being a half of a hemisphere, the two tool rods having different heights, and the two half-circular rods being mated together to form a cylindrical rod body with a step at the tip of the cylindrical rod body.

6. A method according to claim 1, wherein the at least two tool rods include m tool rods, m being more than two, the cross-sectional shape of each tool rod body being a one-$m_{th}$ division of a circle, a head of each rod being a one-$m_{th}$ of a hemisphere, each of the tool rods having a different height, and all of the tool rods being mated together to form a cylindrical rod body with one or more steps at the head of the cylindrical rod body.

7. A method according to claim 1, further comprising the step of rotating each of the tool rods about a planet axis, while rotating the planet axis about the axis of the tool holder.

8. The method according to claim 1, wherein during one revolution, each forming end corresponds to a different contact area, resulting in more than one contact area, and the plurality of forming ends touch and release the sheet material repeatedly, spreading the contact areas along a formed wall of the part, reducing or eliminating plowing in the sheet material and thereby creating a smoother surface.

9. The method according to claim 1, wherein the body and the head of each tool rod share a planet axis and a cross-sectional size of each head is no greater than the cross-sectional size of the body of each respective tool rod.

10. A method of incremental forming a part using a sheet material, the method comprising the steps of:

providing a tool holder having an axis and base;

providing a tool rod mounted to the base of the tool holder, the tool rod having a body and a head, the body having a cross-sectional shape and size, the head along with a portion of a side of the tool rod defining at least two forming ends, each forming end having a different radius or a different distance from the axis of the tool holder or a different height from the base of the tool holder;

applying the tool rod to the sheet material while rotating the tool rod about the axis of the tool holder, the forming ends repeatedly contacting the sheet material at a contact area, the contact area on the sheet material experiencing a 3-dimensional oscillating motion due to the different radii or heights or distances from the axis as one of the forming ends and then another of the forming ends alternatingly contact the contact area thereby creating an at least two-point contact; and forming the sheet material with forming ends of the tool rod.

11. A method according to claim 10, wherein the tool rod has a polygonal cross section defining the at least two forming ends each with an edge, the edges of each forming end having a different radius.

12. A method according to claim 10, wherein the body of the tool rod has a clover-shaped cross section having a plurality of petals, each petal having a length and a radius.

13. A method according to claim 12, wherein a length and/or radius of one of the petals is different than at least one other of the petals.

14. A method according to claim 10, wherein the body of the tool rod has an oval-shaped cross section, one end of the oval shape has a larger radius than the other end.

15. A method according to claim 10, wherein the tool rod has a spiral shape.

16. A method according to claim 10, wherein the tool rod includes one or more protrusions at the head.

17. The method according to claim 10, wherein during one revolution, each forming end corresponds to a different contact area, resulting in more than one contact area, and the plurality of forming ends touch and release the sheet material repeatedly, spreading the contact areas along a formed wall of the part, reducing or eliminating plowing in the sheet material and thereby creating a smoother surface.

18. The method according to claim 10, wherein the head and the body of the tool rod share an axis and a cross-sectional size of the head is no greater than the cross-sectional size of the body.

* * * * *